US008385782B2

(12) United States Patent
Kato

(10) Patent No.: US 8,385,782 B2
(45) Date of Patent: Feb. 26, 2013

(54) IMAGE FORMING APPARATUS

(75) Inventor: Masanori Kato, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 603 days.

(21) Appl. No.: 12/561,577

(22) Filed: Sep. 17, 2009

(65) Prior Publication Data

US 2010/0092195 A1 Apr. 15, 2010

(30) Foreign Application Priority Data

Oct. 14, 2008 (JP) ..... P2008-265373

(51) Int. Cl.
*G03G 15/01* (2006.01)

(52) U.S. Cl. ..... 399/227

(58) Field of Classification Search ..... 399/227, 399/53, 226, 119
See application file for complete search history.

(56) References Cited

U.S. PATENT DOCUMENTS

| | | | | |
|---|---|---|---|---|
| 4,615,612 | A * | 10/1986 | Ohno et al. | 399/227 |
| 2003/0219283 | A1* | 11/2003 | Tamura | 399/227 |
| 2006/0098998 | A1* | 5/2006 | Yamada et al. | 399/53 |

FOREIGN PATENT DOCUMENTS

| | | |
|---|---|---|
| JP | 10-268606 | 10/1998 |
| JP | 2000-250314 A | 9/2000 |

* cited by examiner

*Primary Examiner* — Walter L Lindsay, Jr.
*Assistant Examiner* — Roy Y Yi
(74) *Attorney, Agent, or Firm* — Sughrue Mion, PLLC

(57) ABSTRACT

An image forming apparatus includes an image carrier, a rotary-type developing device and a development control device. The developing device includes a rotation holding member and plural developing units mounted on the rotation holding member. The rotation holding member is configured to stop rotating so that any of the developing units stops in a developing position. The development control device includes a receiving unit, a first determination unit, a first drive control unit and a second drive control unit. The receiving unit receives an image formation instruction relating to a series of image formation processes. The first determination unit determines as to whether or not the series of image formation processes are completed. When the first determination unit makes the determination, the second derive control unit returns the developing unit, which is finally located in the developing position in the image formation processes, to an initial waiting position.

15 Claims, 16 Drawing Sheets

IMAGE FORMATION PROCESS USING SINGLE COLOR (K)

IMAGE FORMATION PROCESS USING PLURAL COLORS (YMCK)

EXEMPLARY EMBODIMENT

COMPARATIVE EXAMPLE

IMAGE FORMING APPARATUS

CROSS-REFERENCE TO RELATED APPLICATIONS

This application is based on and claims priority under 35 USC 119 from Japanese Patent Application No. 2008-265373 filed on Oct. 14, 2008.

BACKGROUND

1. Technical Field

The present invention relates to an image forming apparatus.

2. Related Art

For example, there has been known an image forming apparatus of the electrophotographic type in which a rotary-type developing device including developing units for plural colors is disposed to face an image carrier that carries an electrostatic latent image. In such an image forming apparatus having the rotary-type developing device, when a monochrome image or a color image is to be formed, a rotation of the rotary-type developing device is controlled to move the developing unit for black to a developing position to thereby form the monochrome image or to sequentially move the developing units for the respective colors to the developing position to thereby form the color image.

SUMMARY

According to an aspect of the invention, an image forming apparatus includes an image carrier, a rotary-type developing device and a development control device. The image carrier carries an electrostatic latent image. The rotary-type developing device includes a rotation holding member and a plurality of developing units. The rotation holding member is forwardly and reversely rotatable. The plurality of developing units are mounted on the rotation holding member so that the electro static latent image carried by the image carrier is visualized with a single color or plural colors. The rotation holding member is configured to stop rotating so that any of the developing units stops in a developing position where said any of the developing units faces the image carrier. In a state where said any of the developing units stops in the developing position, said any of the developing unit stopping in the developing position performs a development operation. The development control device controls the rotary-type developing device. Each developing unit of the rotary-type developing device includes a developing container, a developer carrying member and a plurality of stirring-and-conveying members. The developing container has a development opening and a developer circulation path. The development opening faces the image carrier when each developing unit stops in the developing position. The developer circulation path accommodates a two-component developer containing a toner and a carrier and circulates the developer. The developer carrying member faces the development opening of the developing container and carries the developer while rotating. The plurality of stirring-and-conveying members are rotatable and extend in a direction of a rotating axis of the developer carrying member in the developer circulation path of the developing container. The stirring-and-conveying members rotate to stir and convey the developer along the developer circulation path. The development control device includes a receiving unit, a first determination unit, a first drive control unit, and a second drive control unit. The receiving unit receives an image formation instruction relating to a series of image formation processes using the single color or the plural colors. The first determination unit determines as to whether or not the series of image formation processes using the single color or the plural colors in the rotary-type developing device are completed. From time when the receiving unit receives the image formation instruction to time when the first determination unit determines that the series of image formation processes are completed, the first drive control unit rotates the rotation holding member of the rotary-type developing device in a regular rotation direction, and stops one or ones of the developing units in the development position sequentially so that the one or ones of the developing units performs the development operation. When the first determination unit determines that the series of image formation processes are completed, the second derive control unit rotates the rotation holding member of the rotary-type developing device in a reverse rotation direction opposite to the regular rotation direction to return the developing unit, which is finally located in the developing position in the image formation processes using the single color or the plural colors, to an initial waiting position. When any of the developing units is located in the initial waiting position, none of the developing units is located in the developing position.

BRIEF DESCRIPTION OF THE DRAWINGS

Exemplary embodiments of the invention will be described in detail below based on the accompanying drawings, wherein.

DETAILED DESCRIPTION

First of all, description will be given to an outline of an exemplary embodiment of the invention.

Summary of Exemplary Embodiment

Figure 1:
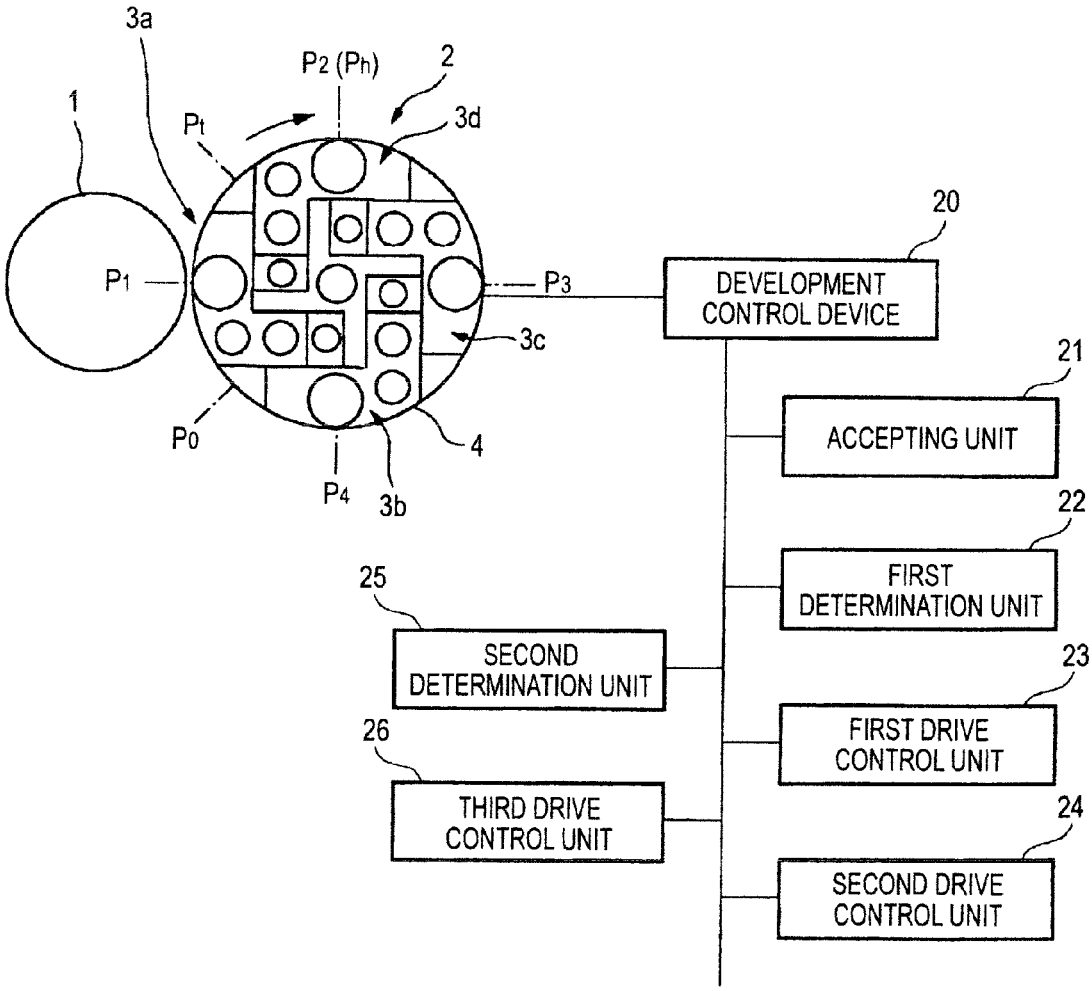
FIG. 1 is an explanatory diagram showing an outline of an image forming apparatus according to one exemplary embodiment of the invention.

FIG. 1 shows an outline of an exemplary embodiment of an image forming apparatus.

In FIG. 1, the image forming apparatus includes an image carrier 1, a rotary-type developing device 2 and a development control device 20. The image carrier 1 carries an electrostatic latent image. The rotary-type developing device 2 includes a rotation holding member 4 and plural developing units 3 (for example, 3*a* to 3*d*). The rotation holding member 4 is forwardly and reversely rotatable. The plural developing units 3 are mounted on the rotation holding member 4 so that the electro static latent image carried by the image carrier 1 is visualized with a single color or plural colors. The rotation holding member 4 is configured to stop rotating so that any of the developing units 3 stops in a developing position $P_1$ where the developing unit 3 faces the image carrier 2. In a state where any of the developing units 3 stops in the developing position $P_1$, the developing unit 3 stopping in the developing position $P_1$ performs a development operation. The development control device 20 controls the rotary-type developing device 2.

When an image formation process is not being carried out, the rotary-type developing device 2 of this type causes any of the developing units 3 to initially stand by in an initial waiting position $P_0$. When any of the developing units 3 is located in the initial waiting position $P_0$, none of the developing units 3 faces the image carrier 1. In the developing device 2 of this type, a consideration is often given to prevent unnecessary toners and carriers from flowing out to the image carrier 1 and a developer from being staving in a certain position so that an excellent developing performance of each of the developing units 3 is kept.

Figure 2:
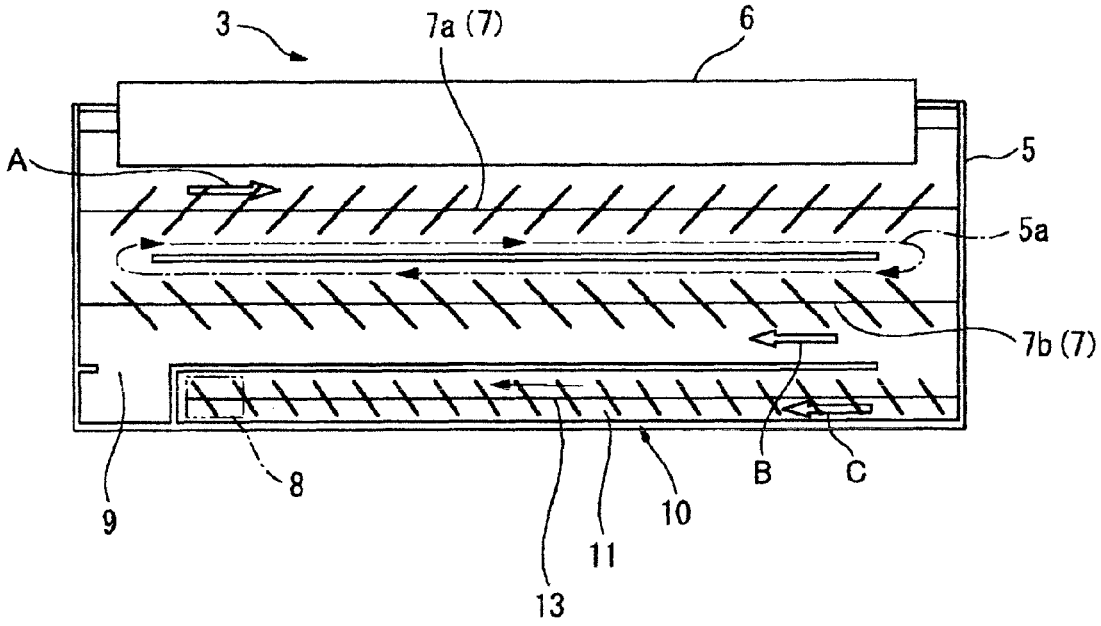
FIG. 2 is an explanatory view showing an outline of a developing unit of a rotary-type developing device shown in FIG. 1.

In the exemplary embodiment, as shown in FIGS. 1 and 2, each of the developing unit 3 (3*a* to 3*d*) of the rotary-type developing device 2 includes a developing container 5, a developer carrying member 6 and plural stirring-and-conveying members 7 (7*a*, 7*b*). The developing container 5 has a development opening and a developer circulation path 5*a*. The development opening faces the image carrier 1 when each developing unit 3 stops in the developing position $P_1$. The developer circulation path 5*a* accommodates a two-component developer containing a toner and a carrier and circulates the developer. The developer carrying member 6 faces the development opening of the developing container 5 and carries the developer while rotating. The plural stirring-and-conveying members 7 are rotatable and extend in a direction of a rotating axis of the developer carrying member 6 in the developer circulation path 5*a* of the developing container 5. The stirring-and-conveying members 7 rotate to stir and convey the developer along the developer circulation path 5*a*.

Examples of the stirring-and-conveying members 7 include one having a spiral blade around an ordinary rotating shaft member. It should be noted that the invention is not limited thereto. A large number of blade members may be properly provided with a tilt in the rotating shaft member, for example.

In each developing units 3 having such a configuration, a developer supplying mechanism and/or a developer discharging mechanism may be further provided as described below.

Let consider the case where, in the rotary-type developing device 2, a image formation process using a specific single color (for example, a image formation process using a single black color) is continuously carried out as shown in FIGS. 1 and 2. In a comparative example, developing unit 3 (for example, the developing unit 3*a*) makes an almost one rotation (moves) from the developing position $P_1$ to the initial waiting position $P_0$ every time the image formation process using the specific single color is completed once. When a next image formation process using the specific single color is designated, the developing unit 3 is moved from the initial waiting position $P_0$ to the developing position $P_1$ again to execute the image formation process using the specific single color, for instance.

In this comparative example, the developing unit 3*a* to be used for the development operation is moved in order of the developing position $P_1$→a waiting position $P_2$→a waiting position $P_3$→a waiting position $P_4$→the initial waiting position $P_0$→the developing position $P_1$ with a rotation operation of the rotation holding member 4 after the end of the image formation process. The stirring-and-conveying members 7 (7*a*, 7*b*) in the developing unit 3*a* is set into a drive stop state during the one rotation of the developing unit 3*a* until the developing unit 3*a* returns to the developing position $P_1$ again. The developer present in a part corresponding to the stirring-and-conveying member 7 (7*a*, 7*b*) is moved in a conveying direction of the stirring-and-conveying members 7 in accordance with the rotation operation of the rotation holding member 4. In the developing unit 3*a* to be used for the development operation, however, a developing operation to be carried out in the next image formation process immediately smoothes the developer which moved due to the driving operation of the stirring-and-conveying member 7 (7*a*, 7*b*).

In less frequently used developing units 3 (for example, 3*b* to 3*d*) which are not used in the development operation for a long period of time, as shown in FIGS. 1 and 2, the stirring-and-conveying members 7 (7*a*, 7*b*) in the less frequently used developing units 3 (for example, 3*b* to 3*d*) are set into the drive stop state, and the developer present in the part corresponding to the stirring-and-conveying members 7 (7*a*, 7*b*) is sequentially moved in the conveying direction of the stirring-and-conveying member 7 in accordance with plural-time rotation operations of the rotation holding member 4 when the rotation of the rotation holding member 4 is repeated plural times (see arrows A and B in FIG. 2). In the less frequently used developing unit 3 (for example, 3*b* to 3*d*), thus, a moving amount of the developer increases an the number of the rotations of the rotation holding member 4 increases, which results in an increase in deviation of the developer to cause density unevenness in a developer distribution. When the less frequently used developing unit 3 is used in the development operation in a state where the deviation of the developer exceeds a certain limit, it is difficult even for a layer-thickness regulating member, which is configured to regulate a layer thickness of the developer, to eliminate a difference (unevenness) in layer thickness of the developer, and an image quality failure such as a density irregularity is apt to be caused.

This exemplary embodiment devises the development control device 20 in order to improve the image quality failure.

More specifically, in this exemplary embodiment, the development control device 20 includes a receiving unit 21, a first determination unit 22, a first drive control unit 23 and a second derive control unit 24. The receiving unit 21 receives an image formation instruction relating to a series of image formation processes using the single color or the plural colors. The first determination unit 22 determines as to whether or not the series of image formation processes using the single color or the plural colors in the rotary-type developing device 2 are completed. From time when the receiving unit 21 receives the image formation instruction to time when the first determination unit 22 determines that the series of image formation processes are completed, the first drive control unit 23 rotates the rotation holding member 4 of the rotary-type developing device 2 in a regular rotation direction $m_1$ (see FIG. 3), and stops one or ones of the developing units 3 in the development position $P_1$ sequentially so that the one or ones of the developing units 3 performs the development operation. When the first determination unit 22 determines that the series of image formation processes are completed, the second derive control unit 24 rotates the rotation holding member 4 of the rotary-type developing device 2 in a reverse rotation direction $m_2$ opposite to the regular rotation direction $m_1$ to return the developing unit 3 (for example, 3*a*), which is finally located in the developing position $P_1$ in the image formation processes using the single color or the plural colors, to an initial waiting position $P_0$.

In this exemplary embodiment, the receiving unit 21 may have any configuration, so long as it can receive and recognize a next image formation instruction. The receiving unit 21 gives information for determining contents of the series of image formation processes to the first drive control unit 23. The "series of image formation processes" indicates image formation process specified as a series of jobs in terms of image forming colors, and a size, a type and the number of recording sheets.

Moreover, the first determination unit 22 may have any configuration so long as it can at least determine as to whether or not the series of image formation processes in the rotary-type developing device 2 is completed. The determination unit 2 may or may not be required to determine as to whether or not a process in a device other than the rotary-type developing device 2, such as a transfer process in a transfer device, is completed.

Furthermore, the first drive control unit 23 may have any configuration so long as irrespective of the image formation instruction, it rotates the rotation holding member 4 in the regular rotation direction $m_1$ and stops the developing unit 3 to be used in the developing position $P_1$ so that the developing unit 3 to be used performs the development operation.

In addition, the second drive control unit 24 may have any configuration so preferably so long as, when the series of image formation processes in the rotary-type developing device 2 is completed, it rotates the rotation holding member 4 in the reverse rotation direction $m_2$ opposite to the regular rotation direction $m_1$ and returns the developing unit 3 (for example, 3*a*), which is finally located in the developing position $P_1$, to the initial waiting position $P_0$.

From the view point of an enhancement in a productivity of the image forming apparatus, when the receiving unit 21 receives a next image formation instruction before the developing unit 3, which is finally located in the developing position $P_1$, is returned to the initial waiting position $P_0$, the first drive control unit 23 may be selected with being given a priority over the second drive control unit 24.

In the rotary-type developing device 2, the following temporary retraction position $P_t$ may be provided.

That is, the initial waiting position $P_0$ may be located upstream of the developing position $P_1$ in the regular rotation direction $m_1$ of the rotation holding member 4. The temporary retraction position $P_t$ may be located in downstream of the developing position $P_1$ in the regular rotation direction $m_1$ of the rotation holding member 4. The second drive control unit 24 may rotate the rotation holding member 4 in the regular rotation direction $m_1$ to move the developing unit 3 (for example, 3*a*), which is finally located in the developing position $P_1$ in the image formation processes using the single color or the plural color, to the temporary retraction position $P_t$. Unless the receiving unit 21 receives a next image formation instruction before a retraction time has elapsed since the developing unit 3 (for example, 3*a*), which is finally located in the developing position $P_1$ in the image formation processes, is moved to the temporary retraction position $P_t$, the second drive control unit 24 may move the rotation holding member 4 in the reverse rotation direction $m_2$ so as to return the developing unit 3 (for example, 3*a*), which is located in the temporary retraction position $P_t$, to the initial waiting position $P_0$.

Particularly, the temporary retraction position $P_t$ may be used as follows. That is, when the receiving unit 21 receives the next image formation instruction before the retraction time has elapsed since the developing unit 3, which is finally located in the developing position $P_1$ in the image formation processes, is moved to the temporary retraction position $P_t$, if the next image formation instruction indicates image formation processes using a single color corresponding to the developing unit 3, which is located in the temporary retraction position $P_t$, the first drive control unit 23 may rotate the rotation holding member 4 in the reverse rotation direction $m_2$ to move the developing unit 3, which is located in the temporary retraction position $P_t$, to the developing position $P_1$ to perform the development operation; and otherwise, the first drive control unit 23 may rotate the rotation holding member 4 in the regular rotation direction $m_1$ to move one or ones of the developing units 3, which are used in image formation processes indicated by the next image formation instruction, sequentially to the development position $P_1$ so that the one or ones of the developing units 3 performs the development operation.

Also, the developing units 3 may be configured as follows. Before the receiving unit 21 receives the image formation instruction, the developing unit 3 (for example, 3*a*) for forming a single color image with a specific color which is most frequently used among the plural colors may be located in the initial waiting position $P_0$ and is closest, along the regular rotation direction $m_1$, to the developing position $P_1$ than the other developing units 3 (for example, 3*b* to 3*d*). In image formation processes using all the plural colors, the first drive control unit 23 may use the other developing units 3 (for example, 3*b* to 3*d*) prior to using the developing unit 3 (for example, 3*a*) of the specific color, and finally use the developing unit 3 (for example 3*a*) of the specific color. For example, it is assumed that the specific color is black (K) and that the color components are Y, M, C and K. In this case, before the receiving unit 21 receives the image formation instruction, the developing unit 3*a* for K is disposed closets to the developing position $P_1$ along the regular rotation direction $m_1$ of the rotation holding member 4 among the developing units 3 (3*a* to 3*d*) of the rotation holding member 4. The other developing units 3 (3*b* to 3*d*) for Y, M and C are optionally disposed in upstream of the developing unit 3*a* for K in the regular rotation direction $m_1$.

Moreover, the developing unit 3 may further include the developer discharging mechanism.

In this case, in addition to the developing container 5, the developer carrying member 6 and the stirring-and-conveying members 7 (7*a*, 7*b*), the developing unit 3 may include a developer discharging port 9 which is provided in a part of the developing container 5 and which can discharge an excess developer.

In this case, the developer discharging port 9 may be always open. Alternatively, an opening cover may be provided so that when the excess developer exceeding a predetermined amount acts on the opening cover, the opening cover is opened to thereby discharge the excess developer. Any method of discharging the excess developer may be selected appropriately. Furthermore, an excess developer collecting portion for collecting the discharged excess developer may be provided in the rotation holding member 4 separately from the developing unit 3 or may be additionally provided as a constituent component of the developing unit 3.

In the configuration in which the developer discharging mechanism is provided, a developer supplying mechanism 10 which will be described later may be provided to supply a new developer through a developer supplying port 8. In this case, a method of supplying the new developer may supply a toner and a carrier separately or mix and supply both of them.

Furthermore, each developing unit 3 provided on the rotary-type developing device 2 may include the developer supplying mechanism 10.

In the case where the developer discharging mechanism is not provided, the developer supplying mechanism 10 may have any configuration so long as it supplies the toner as shown in FIG. 2. Also, in the case where the developer discharging mechanism is provided, the developer supplying mechanism 10 may have any configuration so long as it supplies the toner containing the carrier.

In this exemplary embodiment, the developer supplying mechanism 10 may include a developer conveying member 13 which is provided in a developer supplying path 11 extending in a direction of a rotating axis of the developer carrying member 6 and being connected to a part of the developer circulation path 5*a* of the developing container 5 through a conveying port. The developer conveying member 13 rotates so as to drive and convey the developer toward the conveying port.

In the configuration, as shown by an arrow C of FIG. 2, there is a possibility that, when the rotation of the developer conveying member 13 is stopped, the developer in the developer supplying path 11 might reversely flow in a direction apart from the conveying port as the rotation of the rotation holding member 4.

Moreover, a developing control method in which the developer discharging mechanism is provided will be described below.

Specifically, each developing unit 3 may be configured so that when each developing unit 3 is located in a developer discharging position $P_h$ which is downstream of the developing position $P_1$ in the regular rotation direction $m_1$ of the rotation holding member 4, each developing unit 3 can discharge the excess developer through the developer discharging portion 9. The development control device 20 may further include a second determination unit 25 and a third drive control unit 26. The second determination unit 25 determines as to whether or not an amount of the excess developer to be discharged from the developing unit 3 (for example, 3*a*) of a specific color exceeds a first specific amount. If the second determination unit 25 determines that the amount of the excess developer to be discharged from the developing unit 3 (for example, 3*a*) of the specific color exceeds the first specific amount, the third drive control unit 26 rotates the rotation holding member 4 in the regular rotation direction $m_1$ to move the developing unit 3 (for example, 3*a*) of the specific color to the developer discharging position $P_h$, to discharge the excess developer through the developer discharging port 9 of the developing unit 3 (for example, 3*a*) of the specific color and then to return the developing unit 3 (for example, 3*a*) of the specific color to the initial waiting position $P_0$. If the second determination unit 25 determines that the amount of the excess developer to be discharged is equal to or less than the first specific amount, a series of operations of discharging the excess developer are not carried out.

In the above example, it is premised that the developer discharging mechanism can discharge the excess developer through the developer discharging port 9 when the developer discharging mechanism is located in the developer discharging position $P_h$ which is located downstream of the developing position $P_1$ in the rotation direction of the rotation holding member 4.

The second determination unit 25 may further determine as to whether or not an image formation process using a single color by the same developing unit 3 is continuously repeated. The second determination unit 25 may have any configuration so long as it determines as to whether or not the excess developer to be discharged exceeds the first specific amount. In this case, examples of a technique for determining the amount of the excess developer to be discharged include utilizing information corresponding to (i) an image density to be used in the image formation process, (ii) an amount of the developer to be used in the image formation process and/or (iii) a developer to be supplied.

When the image formation process using the single color by the developing unit 3 for the same color is continuously carried out, it might be concerned that the excess developer cannot be discharged even though the amount of the excess developer to be discharged increases. In order to eliminate this concern, the third drive control unit 26 is configured to perform a drive control process for discharging the excess developer to be discharged when the amount of the excess developer increases.

As an example of the second determination unit 25, the second determination unit 25 may accumulate a value indicated by information corresponding to an amount of the new developer supplied through the developer supplying port 8 and determine as to whether or not the amount of the excess developer to be discharged from the developing unit 3 (for example, 3*a*) of the specific color exceeds the first specific amount, based on whether or not the accumulated value exceeds a second specific value.

As an example of the third drive control unit 26, the third drive control unit 26 may initialize the value accumulated by the second determination unit 25 when the accumulated value exceeds the second specific value or when image formation processes are performed based on an image formation instruction for enabling the developing unit 3 (for example, 3*a*) of the specific color to pass through the developer discharging position $P_h$, before the accumulated value exceeds the second specific value. Examples of the information corresponding to the amount of the new developer supplied include a time required for the developer supplying mechanism 10 to perform the supply operation performed and an amount of a toner used in the image formation process which is a basis for determining the amount of the new developer supplied.

Also, as an example of the drive control process carried out by the third drive control unit 26, if the second determination unit 25 determines that the amount of the excess developer to be discharged from the developing unit 3 (for example, 3*a*) of the specific color exceeds the first specific amount, the third drive control unit 26 stops rotation of the rotation holding member 4 to stop the developing unit 3 (for example, 3*a*) of the specific color in the developer discharging position $P_h$, causes the excess developer to be discharged through the developer discharging port 9 of the developing unit 3 (for example. 3*a*) of the specific color and then, rotates the rotation holding member 4 again.

Also, as an example of the third drive control unit 26, at a time when the first determination unit 22 determines that the series of image formation processes are completed, a priority is given to a control process performed by the third drive control unit 26 over a control process performed by the second drive control unit 24. If the second determination unit 25 determines that the excess developer is equal to or less than the first specific amount at the time when the first determination unit 22 determines that the series of image formation processes are completed, the second drive control unit 24 rotates the rotation holding member 4 of the rotary-type developing device 2 in the reverse rotation direction $m_2$ to return the developing unit 3 (for example, 3*a*), which is finally located in the developing position $P_1$ in the image formation processes, to the initial waiting position $P_0$.

Next, a developing control process to be carried out by the development control device 20 according to the exemplary embodiment will be described with reference to FIGS. 3A and 3B.

Figure 3A:
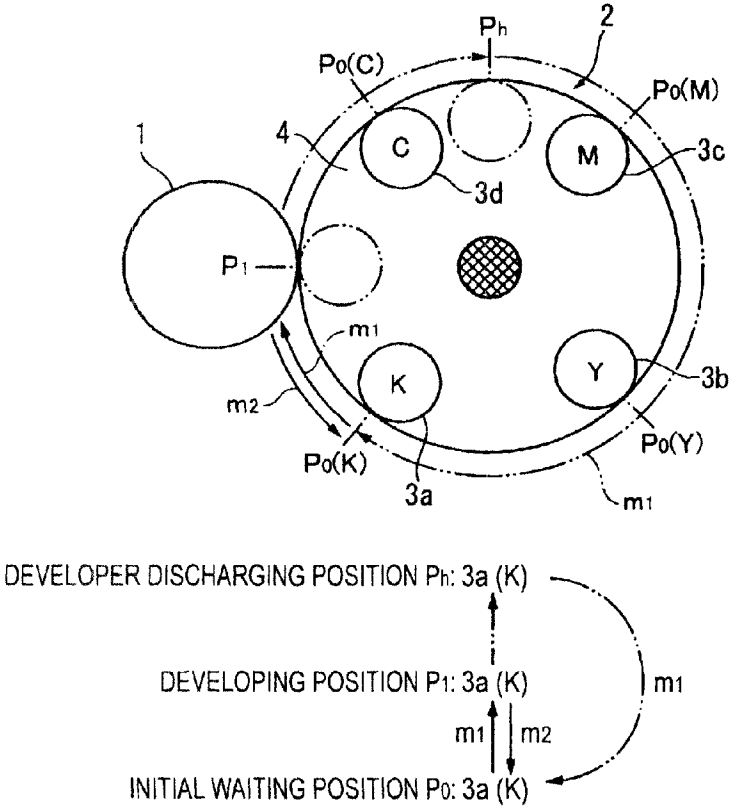
FIG. 3A is an explanatory view showing an example of an image formation process using a single color (K) in the image forming apparatus according to the exemplary embodiment illustrated in FIG. 1.
Figure 3B:
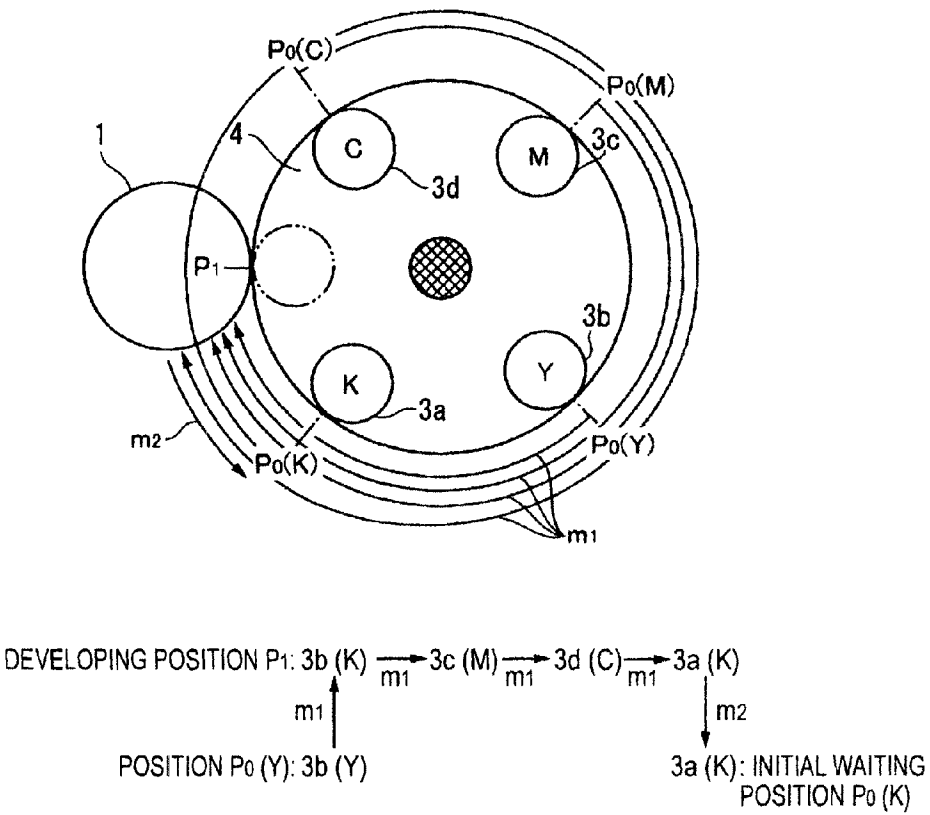
FIG. 3B is an explanatory view showing an example of an image formation process using plural colors (YMCK) in the image forming apparatus according to the exemplary embodiment shown in FIG. 1.

FIG. 3A shows an image formation process using a single color (K), and FIG. 3B shows an image formation process using plural colors (YMCK).

—Image Formation Process Using Single Color (K)—

In FIG. 3A, it is assumed that the initial waiting position $P_0$ is disposed upstream of the developing position $P_1$ in the regular rotation direction $m_1$ of the rotation holding member 4, and that the initial waiting position $P_0$(K) is set so that when the developing unit 3*a* (for K) is located in the initial waiting position $P_0$(K), the developing unit 3*a* (for K) is closer to the developing position $P_1$ than the other developing units 3*b*, 3*c*, 3*d* (for Y,M and C). Also, it is assumed that when the developing unit 3*a* (for K) is located in the initial waiting position $P_0$(K), the developing units 3*b*, 3*c*, 3*d* (for Y, M, K) are located in positions $P_0$(Y). $P_0$(M), and $P_0$(C), respectively.

By taking this configuration as an example, description will be given on the image formation process using the single color (K). When the receiving unit 21 accepts an image formation instruction related to the image formation process using the single color (K), the first drive control unit 23 operates until the first determination unit 22 determines that a series of image formation processes is completed. Specifically, the first drive control unit 23 rotates the K-color developing unit 3*a* (K) located in the initial waiting position $P_0$(K) in the regular rotation direction $m_1$ and stops the K-color developing unit 3*a* (K) in the developing position $P_1$ so that a developing operation of the image formation process using the single color (K) is carried out. When the series of image formation processes is completed, the second drive control unit 24 operates. Specifically, the second drive control unit 24 rotates the K-color developing unit 3*a* (K) in the reverse rotation direction $m_2$ and returns the K-color developing unit 3*a* (K) to the initial waiting position $P_0$(K).

At this time, the developing units 3 (in the example, 3*b* (Y) to 3*d* (C)) which are not used in the image formation process are also rotated by a predetermined amount in the regular rotation direction $m_1$ in the same manner as the K-color developing unit 3*a* (K) and are then rotated in the reverse rotation direction $m_2$ and returned to the original positions $P_0$(Y) to $P_0$(C). Therefore, even if the developer is deviated in the developing units 3 (in the example, 3*b* (Y) to 3*d*(C)), the deviation of the developer in the developing units 3 is effectively smoothed as the developing units 3 rotates in the reverse rotation direction $m_2$.

If this exemplary embodiment is configured so that the excess developer can be discharged in the developer discharging position $P_h$, the third drive control unit 26 operates based on a result of the determination made by the second determination unit 25 shown in FIG. 1. If the second determination unit determines that the operation for discharging the excess developer is required, the third derive control unit 26 rotates the K-color developing unit 3*a* (K), which is located in the developing position $P_1$, in the regular rotation direction $m_1$ and set the K-color developing unit 3*a* (K) to the developer discharging position $P_h$ so as to discharge the excess developer. Then, the third derive control unit 26 rotates the K-color developing unit 3*a* (K) in the regular rotation direction $m_1$ and returns the K-color developing unit 3*a* (K) to the initial waiting position $P_0$(K), for example.

When the image formation process using the single color by the K-color developing unit 3*a* (K) is repeatedly carried out, the excess developer increases as the developer is supplied to the K-color developing unit 3*a* (K). If the K-color developing unit 3*a* (K) is simply reciprocated between the initial waiting position $P_0$(K) and the developing position $P_1$, it is concerned that the excess developer might increase excessively, which results in deterioration of a developing performance. In the situation, therefore, the operation for discharging the excess developer may be performed effectively.

—Image Formation Process Using Plural Colors (YMCK)—

With reference to FIG. 3B, description will be given on an image formation process using plural colors (YMCK). When the receiving unit 21 receives an image formation instruction related to the image formation process using the plural colors (YMCK), the first drive control unit 23 operates until the first determination unit 22 determines that a series of image formation processes are completed. Specifically, the first drive control unit 23 rotates the Y-color developing unit 3*b* (Y), which is located in the position $P_0$(Y), in the regular rotation direction $m_1$ and sets the Y-color developing unit 3*b* (Y) to the developing position $P_1$ so that a developing operation of the image formation process using an yellow component (Y) is carried out. Subsequently, the first drive control unit 23 rotates the M-color developing unit 3*c* (M), the C-color developing unit 3*d* (C) and the K-color developing unit 3*a* (K) in the regular rotation direction $m_1$ and sequentially sets the M-color developing unit 3*c* (M), the C-color developing unit 3*d* (C) to the developing position $P_1$ so that a necessary developing operation of the image formation process using each of the color components (M, C, K) is carried out.

When the series of image formation processes are completed, the second drive control unit 24 operates. Specifically, the second drive control unit 24 rotates the K-color developing unit 3*a* (K), which is finally located in the developing position $P_1$, in the reverse rotation direction $m_2$ and returns the K-color developing unit 3*a* (K) to the initial waiting position $P_0$(K).

Exemplary embodiments of the invention will be described below in more detail with reference to the accompanying drawings.

FIRST EXEMPLARY EMBODIMENT

Whole Structure of Image Forming Apparatus

Figure 4:
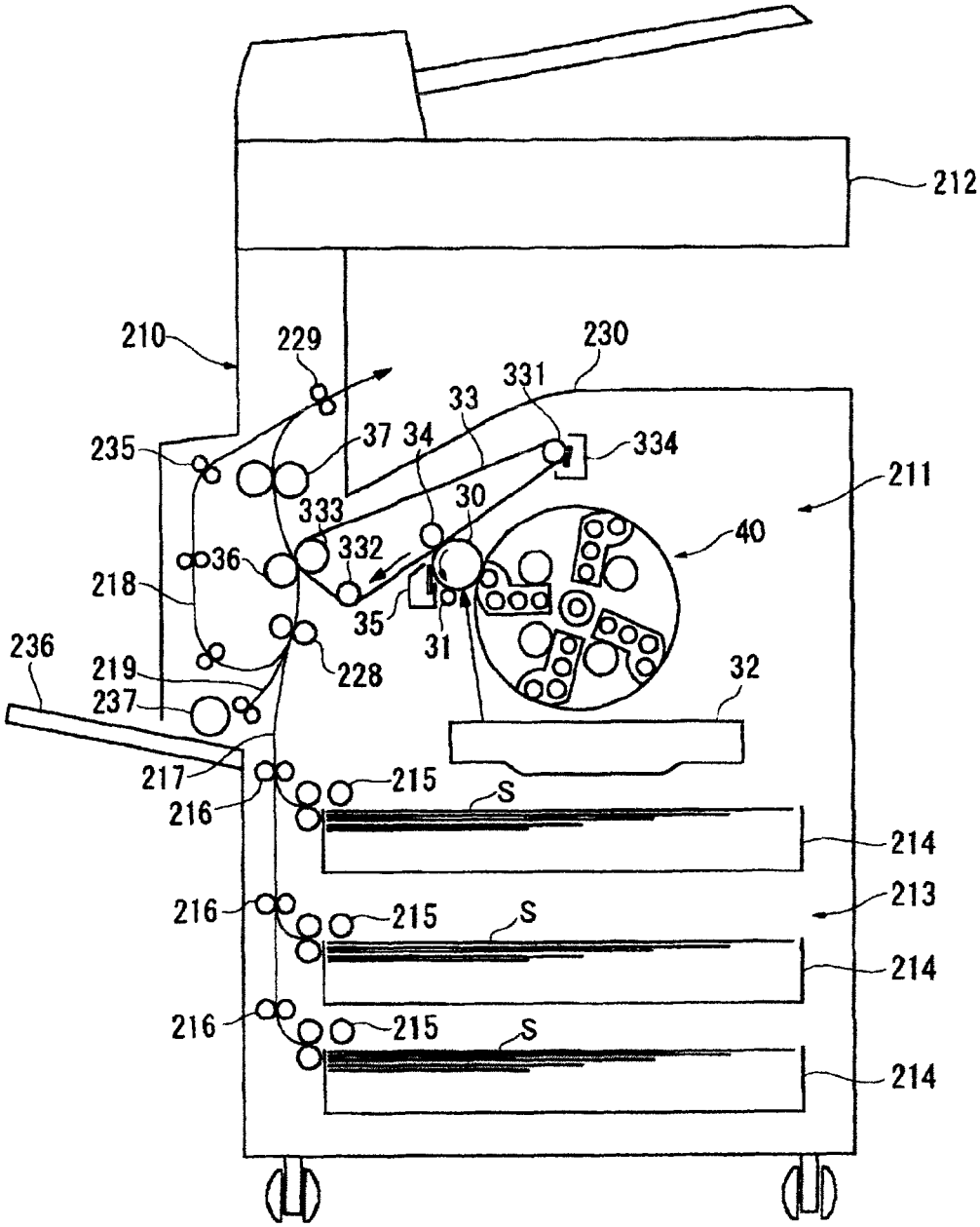
FIG. 4 is an explanatory view showing an outline of an image forming apparatus according to a first exemplary embodiment.

FIG. 4 shows an image forming apparatus according to an exemplary embodiment of the invention.

In FIG. 4, the image forming apparatus according to the exemplary embodiment includes a device housing 210 and an image reading portion 212. The device housing 210 has an image forming portion 211 for forming an image on a recording material by using the electrophotographic method, for example. The image reading portion 212 is provided on the device housing 210 and reads an image of an original. Moreover, a recording material supplying portion 213 for supplying a recording material S to the image forming portion 211 is provided below the image forming portion 211 in the device housing 210.

The image forming portion 211 according to the exemplary embodiment includes a photosensitive member 30, a charger 31, an exposure device 32, an intermediate transfer member 33, a primary transfer unit 34, a cleaning device 35, a secondary transfer unit 36 and a fixing unit 37. The photosensitive member 30 is an example of an image carrier which is rotationally supported on a frame of the device housing 210, for example, and carries an electrostatic latent image. The charger 31 charges the photosensitive member 30. The exposure device 32 writes the latent image onto the photosensitive member 30 thus charged. The rotary-type developing device 40 changes the electrostatic latent image formed on the photosensitive member 30 into a visible image with a developer for a single color or a full color, for example. The intermediate transfer member 33 intermediately carries a toner image, which is visualized by the rotary-type developing device 40 and transferred from the photosensitive member 30 before the toner image is transferred onto the recording material S. The primary transfer unit 34 primarily transfers, onto the intermediate transfer member 33, the toner image on the photosensitive member 30. The cleaning device 35 cleans away a toner remaining on the photos member 30. The secondary transfer unit 36 secondarily transfers the toner image on the intermediate transfer member 33 to the recording material S. The fixing unit 37 fixes the toner image transferred onto the recording material S.

The intermediate transfer member 33 is wound around plural stretching rolls 331 to 333 and is circulated by using the stretching roll 331 as a driving roll, for example. An intermediate cleaning device 334 for cleaning away the toner remaining on the intermediate transfer member 33 is provided in an opposed position to the stretching roll 331. The secondary transfer unit 36, which uses the stretching roll 333 as a backup roll, is provided in an opposed position to the stretching roll 333. A secondary transfer bias in a direction in which the toner image on the intermediate transfer member 33 is transferred onto the recording material S in the secondary transfer is applied to both of them. In particular, the secondary transfer unit 36 according to the exemplary embodiment can approach to and separate from the intermediate transfer member 33 by means of an approaching and separating mechanism (which is not shown).

The recording material supplying portion 213 has plural recording material housing cassette 214 for accommodating the recording materials S and sequentially feeds the recording materials S through feeding members 215 which are additionally provided on the recording material housing cassettes 214, and supplies them to the image forming portion 211 through a proper number of conveying members 216.

A recording material conveying system in the image forming portion 211 according to the exemplary embodiment is configured as follows. The recording material S conveyed from the recording material supplying portion 213 to the image forming portion 211 travels along a main conveying path 217 directing upward. The main conveying path 217 is provided with a positioning roll 228 and a discharging roll 229. The positioning roll 228 once positions the recording material S and then conveys the recording material S to a secondary transfer part (a part in which the secondary transfer unit 36 and the stretching roll 333 face each other) on a downstream side. The discharging roll 229 discharges the recording material S subjected to the fixing process to a recording material discharging portion 230 provided on an upper surface of the device housing 210. On an upstream side of the discharging roll 229, there is provided an inversion conveying path 218 for inverting and returning the recording material S subjected to the fixing operation in a direction different from the recording material discharging portion 230. For example, the inversion conveying path 218 is utilized for forming images on both sides of the recording material S and returns and conveys the recording material S to a position in the vicinity of an upstream side of the positioning roll 228 by means of plural conveying members 235. In this exemplary embodiment, furthermore, a manual conveying path 219 is provided to enable a manual supply of the recording material S. The recording material S put on a manual supplying portion 236 is conveyed to the manual conveying path 219 by means of a feeding member 237.

In order to form a color image by the image forming apparatus, the operation for primarily transferring the toner image formed on the photosensitive member 30 to the intermediate transfer member 33 is repeated to form superposed toner images on the intermediate transfer member 33. Corresponding to the formation of the superposed toner images on the intermediate transfer member 33, the recording material S is conveyed from the recording material supplying portion 213, and the superposed toner images on the intermediate transfer member 33 are collectively transferred (secondarily transferred) onto the recording material S in the secondary transfer part. Then, the recording material S having the superposed toner image transferred thereto may be fixed by the fixing unit 37 through heating and pressurization, for example, and may be discharged from the discharging roll 229 to the recording material discharging portion 230.

—Rotary-Type Developing Device—

Next, the rotary-type developing device 40 will be described in detail.

Figure 5:
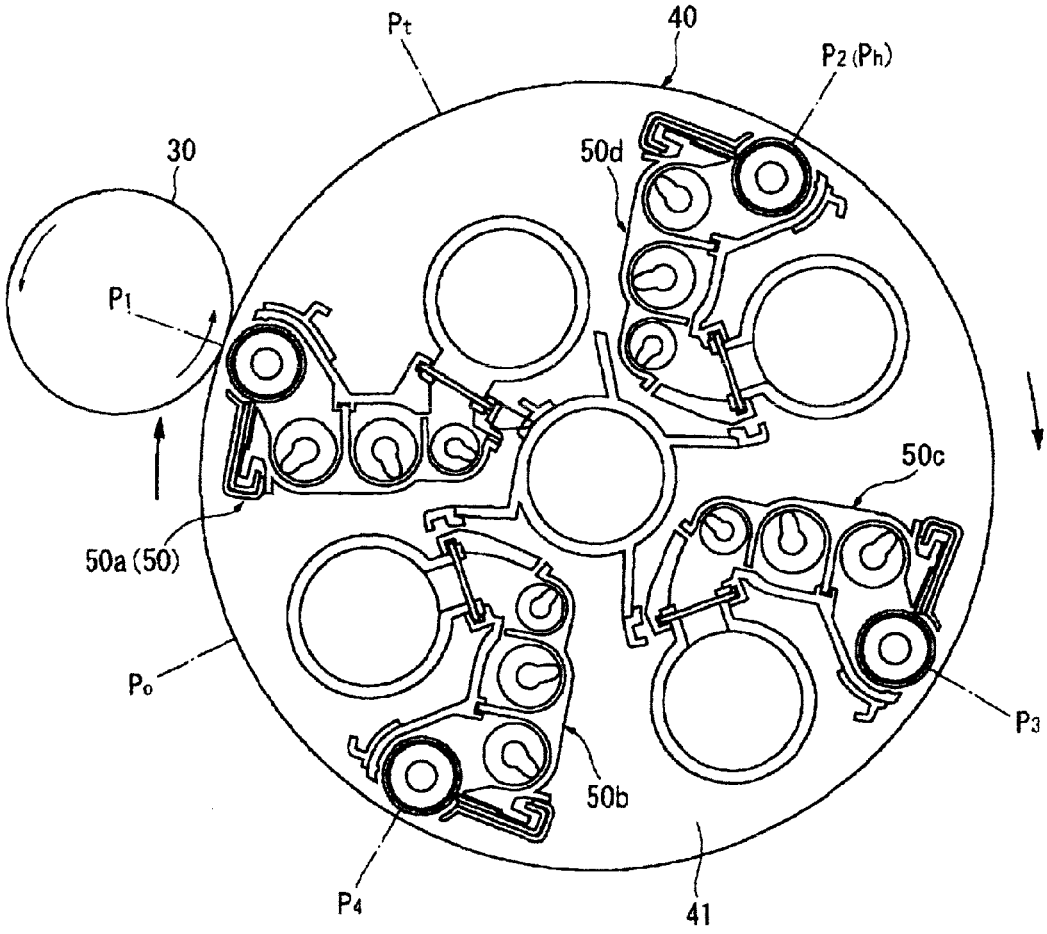
FIG. 5 is an explanatory view showing an outline of a rotary-type developing device according to the first exemplary embodiment.

As shown in FIG. 5, the rotary-type developing device 40 has a rotation holding member 41 which is rotatable. The rotation holding member 41 is provided with plural developing units 50 (50*a* to 50*d*). Each of the developing units 50 uses a two-component developer containing toners and carriers for four colors of black (K color), yellow (Y color), magenta (M color) and cyan (C color), for example.

In the rotary-type developing device 40 according to this exemplary embodiment, a position in which each of the developing units 50 is opposed to the photosensitive member 30 is referred to as a "developing position $P_1$". Also, an initial waiting position $P_0$ is set so that when the K-color developing units 50*a* is located in the initial waiting position $P_0$, none of the developing units 50 is located the developing position $P_1$. In this example, the initial waiting position $P_0$ is set to a position on an upstream side of the developing position $P_1$ in a regular rotation direction (a direction indicated by an arrow in the figure) which is a forward rotation direction of the rotation holding member 41 (for example, the initial waiting position $P_0$ is set so that an angle between (i) a segment connecting the initial waiting position $P_0$ and a rotation shaft of the rotation holding member 41 and (ii) a segment connecting the developing position $P_1$ and the rotation shaft of the rotation holding member 41 is about 20 degrees).

In this exemplary embodiment, furthermore, there is provided a temporary retraction position $P_t$ in which the K-color developing unit 50*a* is temporarily retreated after the completion of the development operation. The temporary retraction position $P_t$ is set to a position on a downstream side of the developing position $P_1$ in the regular rotation direction (for example, the temporary retraction position $P_t$ is set so that an angle between (i) a segment connecting the temporary retraction position $P_t$ and the rotation shaft of the rotation holding member 41 and (ii) a segment connecting the developing position $P_1$ and the rotation shaft of the rotation holding member 41 is approximately 20°). By providing such a temporary retraction position $P_t$, an unnecessary developer is prevented from being scattered toward the photosensitive 30 immediately after the developing operation using the K-color developing unit 50*a*, for example. In addition, in the case where image formation processes using the K color is changed to image formation processes using the full colors, the development operation using the Y color is executed in an early stage.

All of the developing units 50 (50*a* to 50*d*) have the same structure and are disposed almost equally with respect to the rotation holding member 41 in this exemplary embodiment. However, the invention is not limited thereto. Each of the developing units 50 may be disposed unequally with respect to the rotation holding member 41.

An example in which the developing units 50 are disposed unequally will be described supplementarily. For example, a supply developer container 80 (see FIG. 6) of the K-color developing unit 50 (50*a*) may be set to be larger than those of the other developing units 50 (50*b* to 50*d*) in consideration of an consumption amount of the developer of the K-color developing unit 50 (50*a*), for example.

—Whole Structure of Developing Unit—

Figure 6:
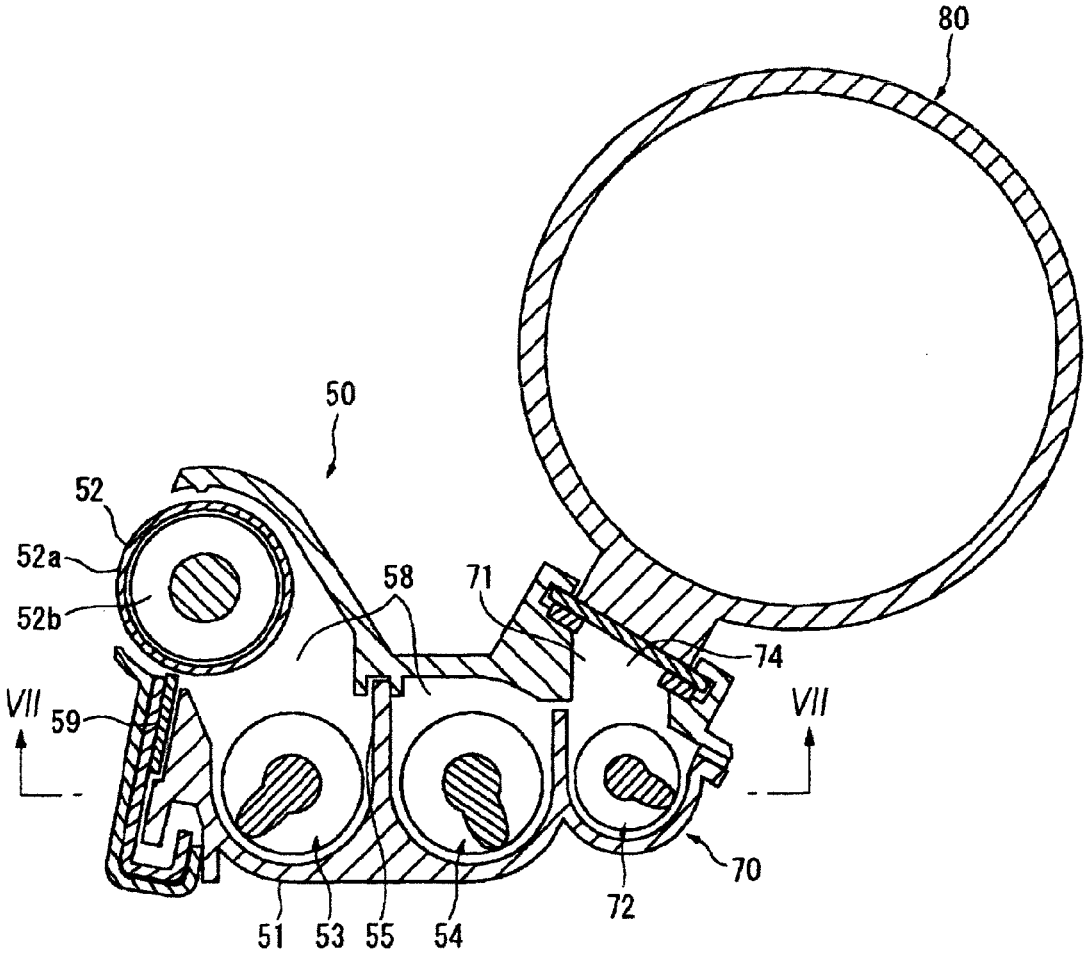
FIG. 6 is an explanatory view showing an outline of a developing unit according to the first exemplary embodiment.
Figure 7:
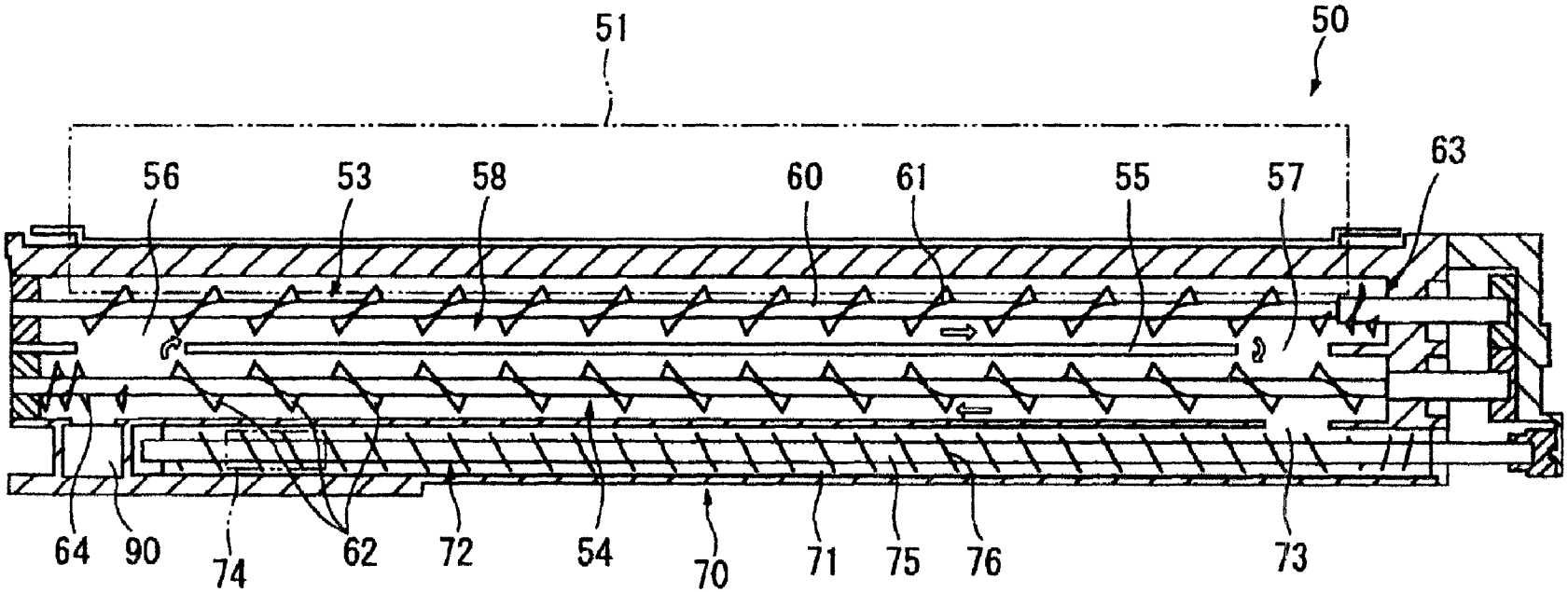
FIG. 7 is an explanatory section view of the developing unit taken along a VII-VII line in FIG. 6.

For example, as shown in FIGS. 6 and 7, each developing unit 50 according to this exemplary embodiment has a developing container 51, a developing roll 52, a pair of stirring-and-conveying members 53 and 54, a partition wall and developer passing ports 56 and 57. When the developing unit 50 is located in the developing position $P_1$, the developing container 51 is opened toward the photosensitive member 30. The developing container 51 accommodates the developer containing the toner and the carrier for each color component. The developing roll 52 holds and conveys the developer and is rotatably provided in a part facing the opening of the developing container 51. The pair of stirring-and-conveying members 53 and 54 are rotatably provided along a rotating axis of the developing roll 52 on a rear side of the developing roll 52 in the developing container 51. The partition wall 55 is provided on the developing container 51 and is located between the stirring-and-conveying members 53 and 54. The developer passing ports 56 and 57 are formed in the vicinity of both ends of the partition wall 55, and the developer which is conveyed through the stirring-and-conveying members 53 and 54 is circulated in a developer circulation path 58 through the passing ports 56 and 57. In this exemplary embodiment, the stirring-and-conveying member 53 on the developing roll 52 side serves as a first stirring-and-conveying member which mainly supplies the developer to the developing roll 52, and the stirring-and-conveying member 54 provided on the rear side serves as a second stirring-and-conveying member which mainly mixes and stirs the developer.

In the developing roll 52, a magnet member 52*b* provided with a proper number of magnetic poles is fixedly disposed in a non-magnetic developing sleeve 52*a* which is rotatable. A layer thickness regulating member 59 for regulating a layer thickness of the developer to be conveyed toward the developing position $P_1$ by means of the developing roll 52 is disposed opposite to the developing roll 52 with a predetermined gap. Also, the stirring-and-conveying members 53 and 54 have spiral blades 61 and 62 provided around a rotating shaft member 60, for example. The spiral blades 61 and 62 of the stirring-and-conveying members 53 and 54 are formed in such a manner that the developer conveying directions are reverse to each other when the stirring-and-conveying members 53 and 54 are rotated in the same direction. Reverse-direction spiral blades 63 and 64 are provided on both ends of the stirring-and-conveying members 53 and 54 so that the developer can be circulated and conveyed in the developer circulation path 58 through the passing ports 56 and 57.

—Developer Supplying Mechanism—

In this exemplary embodiment, furthermore, there is provided a developer supplying mechanism 70 for supplying the developer from the developer supplying container 80 corresponding to the developing unit 50. The developer supplying mechanism 70 includes a developer supplying path 71, a rotating-and-conveying member 72 and a conveyance port 73. The developer supplying path 71 is provided on a rear of the second stirring-and-conveying member 54 along a longitudinal direction of the developer circulation path 58 in the developing container 51. The rotating-and-conveying member 72 is rotatably provided along the developer supplying path 71. The conveyance port 73 for conveying the developer to be supplied to the developer circulation path 58 is provided in the vicinity of a downstream side end in a conveying direction in which the rotating-and-conveying member 72 conveys the developer.

The rotating-and-conveying member 72 has a spiral blade 76 provided around a rotating shaft member 75 in the same manner as the stirring-and-conveying members 53 and 54. The spiral blade 76 is configured so that the supply developer in the developer supplying path 71 can be moved in a direction away from the conveyance port 73 when the rotation holding member 41 is rotated in the regular rotation direction with the rotating-and-conveying member 72 being stopped.

Also, a developer supplying port 74 is provided in the vicinity of an upstream end in the developer conveying direction of the developer supplying path 71 so that the developer can be supplied to the developer supplying path 71. The supply developer container 80 including a supply developer containing a color toner corresponding to the developing unit 50 is connected to the developer supplying port 74. Therefore, the developer is supplied from the supply developer container 80 to the developing unit 50 well in a posture state in which the supply developer container 80 is provided above the developing unit 50 in response to the rotation of the rotation holding member 41.

The supply developer container 80 according to this exemplary embodiment has a cylindrical shape, for example. The supply developer container 80 has an inner part which is divided into (i) a housing chamber for accommodating the supply developer and (ii) a collecting chamber for collecting an excess developer discharged from the developing unit 50 through a developer collecting mechanism (which will be described later). A spring-like conveying member which is wound spirally is provided in the housing chamber, and the supply developer in the housing chamber is fed to the developer supplying port 74.

—Developer Discharging Mechanism—

In the exemplary embodiment, the developing unit 50 includes a developer discharging mechanism 90 which can discharge an excess developer.

Figure 8A:
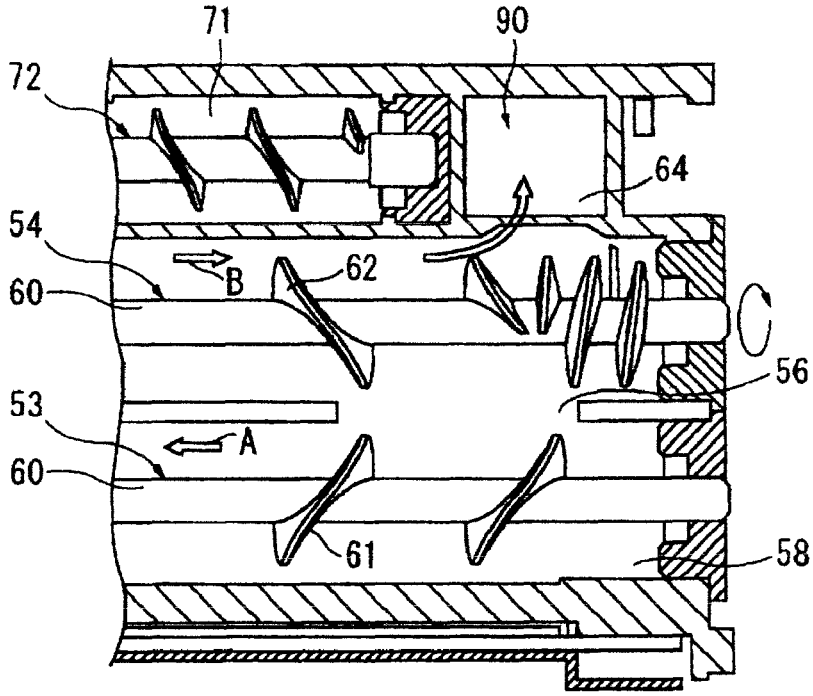
FIG. 8A is an explanatory view showing details in the vicinity of a developer discharging port according to the first exemplary embodiment.
Figure 8B:
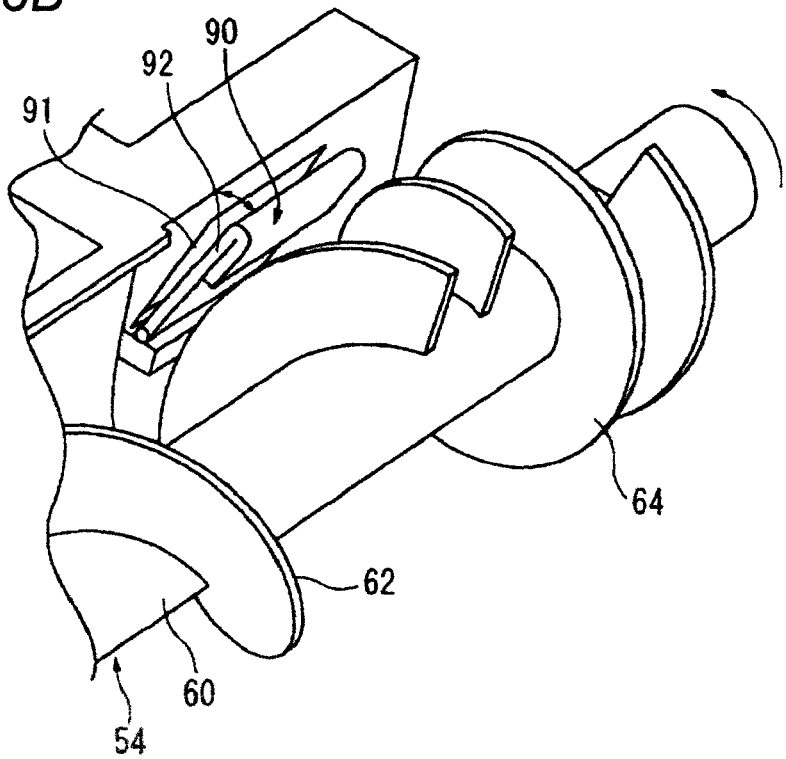
FIG. 8B is a perspective view showing a main part of FIG. 8A.

As shown in FIGS. 7, 8A and 8B, the developer discharging mechanism 90 is provided on a sidewall of the developing container 51 which is opposed to the passing port 56 and is provided in a part where the stirring-and-conveying member 54, which is apart from the developing roller 52, is accommodated in the developer circulation path 58.

The developer discharging mechanism 90 has a developer discharging port 91 which is opened in a proper position of the sidewall of the developer container 51. An opening cover 92 is rotatably provided on the developer discharging port 91. The opening cover 92 aids the developer discharging operation when the developer in the developer circulation path 58 increases and the amount of the excess developer exceeds a predetermined amount. Also, the opening color 92 is brought into a closing state to prevent the developer from being discharge excessively when the posture of the developing unit 50 is changed in accordance with the rotation of the rotation holding member 41.

In this exemplary embodiment, the excess developer is directly collected into a small chamber (not shown) for a developer collection which is provided in the supply developer container 80, for example.

—Control System—

Figure 9:
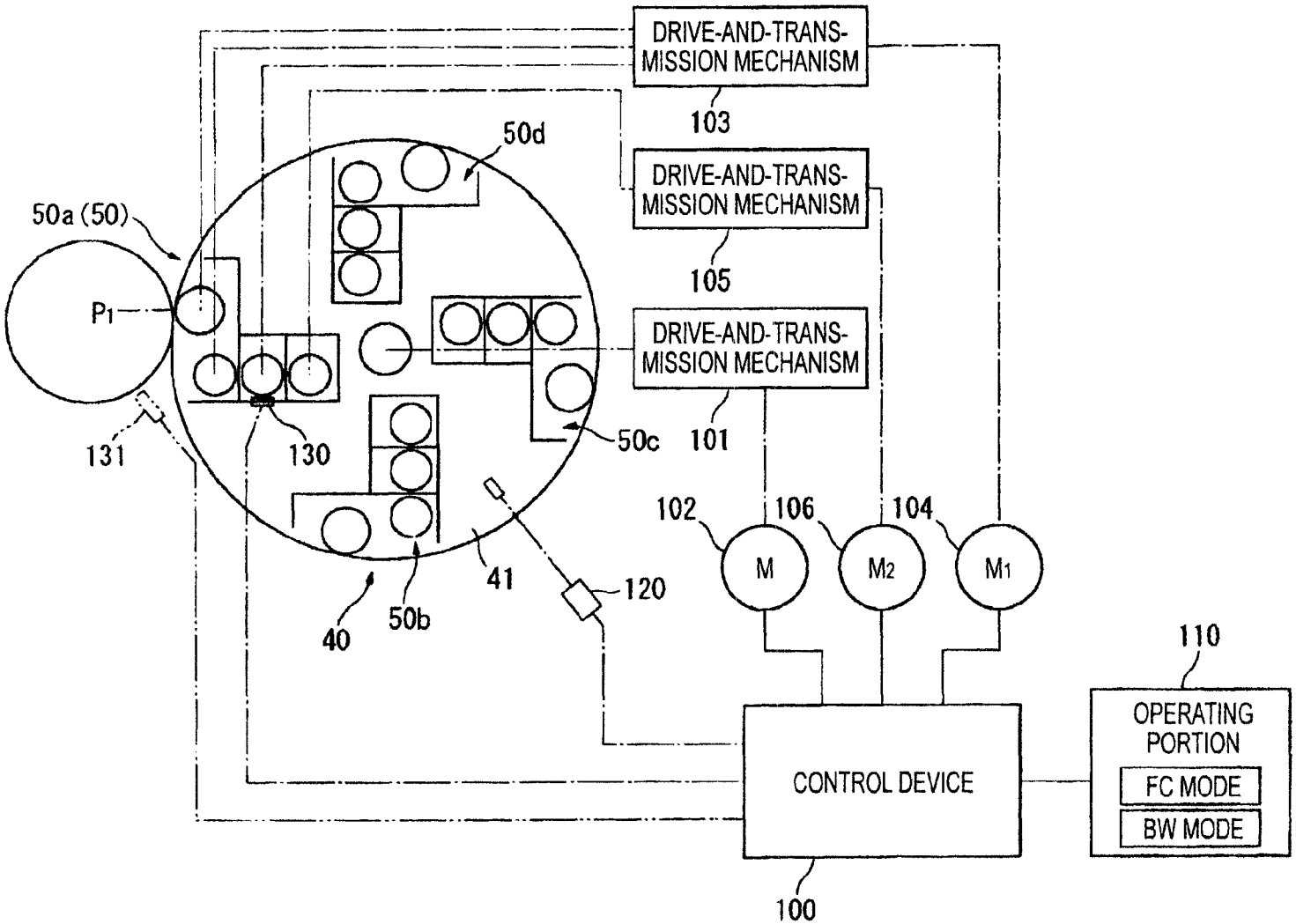
FIG. 9 is an explanatory diagram showing a control system according to the first exemplary embodiment.

FIG. 9 shows a control system for the rotary-type developing device according to this exemplary embodiment.

In FIG. 9, a reference numeral 100 denotes a control device having a microcomputer or the like. The control device 100 is configured to carry out a drive control and a density control for the rotary-type developing device 40.

Drive control targets in the rotary-type developing device 40 include a driving motor 102, a driving motor 104 and a driving motor 106. The driving motor 102 drives the rotation holding member 41 through a drive-and-transmission mechanism 101 such as a gear. The driving motor 104 drives the developing roll 52 of the developing unit 50 and the stirring-and-conveying members 53 and 54 through a drive-and-transmission mechanism 103 such as a gear when the developing unit 50 is located in the developing position $P_1$. The driving motor 106 drives the rotating-and-conveying member 72 of the developing unit 50 through a drive-and-transmission mechanism 105 such as a gear when the developing unit 50 is located in the developing position $P_1$. The control device 100 receives (i) an instruction signal for an image formation mode (a single color black mode (a BW mode) or a full color mode (an FC mode)) which is sent from a personal computer (not shown) or an operating portion 110 and/or (ii) a signal sent from a rotation detector 120 for detecting that the rotation holding member 41 is rotated. Then, the control device 100 sends a predetermined drive control signal to each of the driving motors 102, 104 and 106. An encoder for detecting a rotation operation of the rotation holding member 41 is used as the rotation detector 120.

In this exemplary embodiment, furthermore, information corresponding to an amount of the developer supplied from the developer supplying mechanism 70 is used to discharge the excess developer. For example, the information corresponding to the amount of the developer supplied from the developer supplying mechanism 70 is a time required for the motor 106 to supply the developer from the developer supplying mechanisms 70 of each developing unit 50 to the developer circulation path 58 of each developing unit 50. The information corresponding to the amount of the developer supplied from the developer supplying mechanism 70 of each developing unit 50 is accumulated at each time, and is then stored in a storing portion of the control device 100.

The density control is performed for the rotary type developing unit 40, for example, as follows. That is, a toner density in the developer is grasped by means of a density detector that can detect the toner density of the developer in the developing unit 50 (for example, a detector for detecting a magnetic permeability is used), for instance, and the developer supplying operation is controlled based thereon.

A density detection method is not limited to a method of carrying out a direct detection from the developer in the developing unit 50, but it is also possible to form an image density detection pattern on the photosensitive member 30 and to detect the same pattern by means of an optical type density detector 131 as shown in a two-dotted chain line of FIG. 9, for example.

—Developing Control Process by Control Device—

Figure 10:
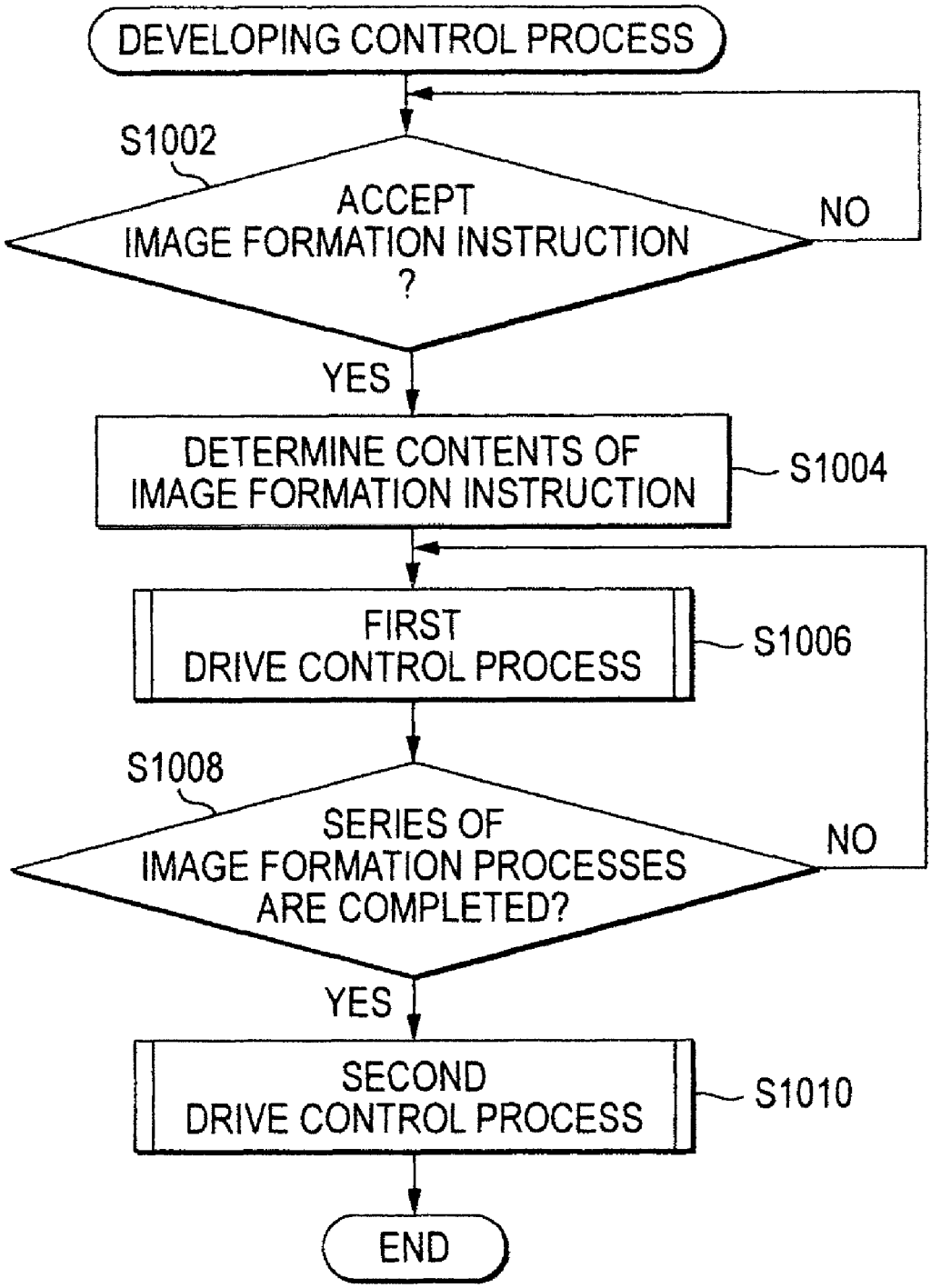
FIG. 10 is a flowchart showing a developing control process according to the first exemplary embodiment.

FIG. 10 is a flowchart showing a developing control process to be carried out by the control device 100.

The control device 100 determines at step S1002 as to whether or not receiving the instruction signal for the image formation mode from the operating portion 110, for example. If receiving the instruction signal (Yes at step S1002), the control device 100 proceeds to step S1004. Otherwise (No at step S1002), the control device repeats the step S1002. At the step S1004, the control device 100 confirms contents of an image formation instruction indicated by the instruction signal, and then executes a first drive control process (drive control process during image formation) at step S1006. The control device 100 determines at step S1008 as to whether or not a series of image formation processes are completed. If the control device 100 determines that the series of image formation processes have not yet completed (No at step S1008), the control device 100 repeats the first drive control process at the step S1006. In other words, the control device 100 performs the first drive control process until the control device 100 determines that the series of image formation processes are completed. If the control device 100 determines that the series of image formation processes are completed (Yes at step S1008), the control device 100 executes a second drive control process (derive control process at an end of the image formation) (at step S1010).

—First Drive Control Process—

Figure 11:
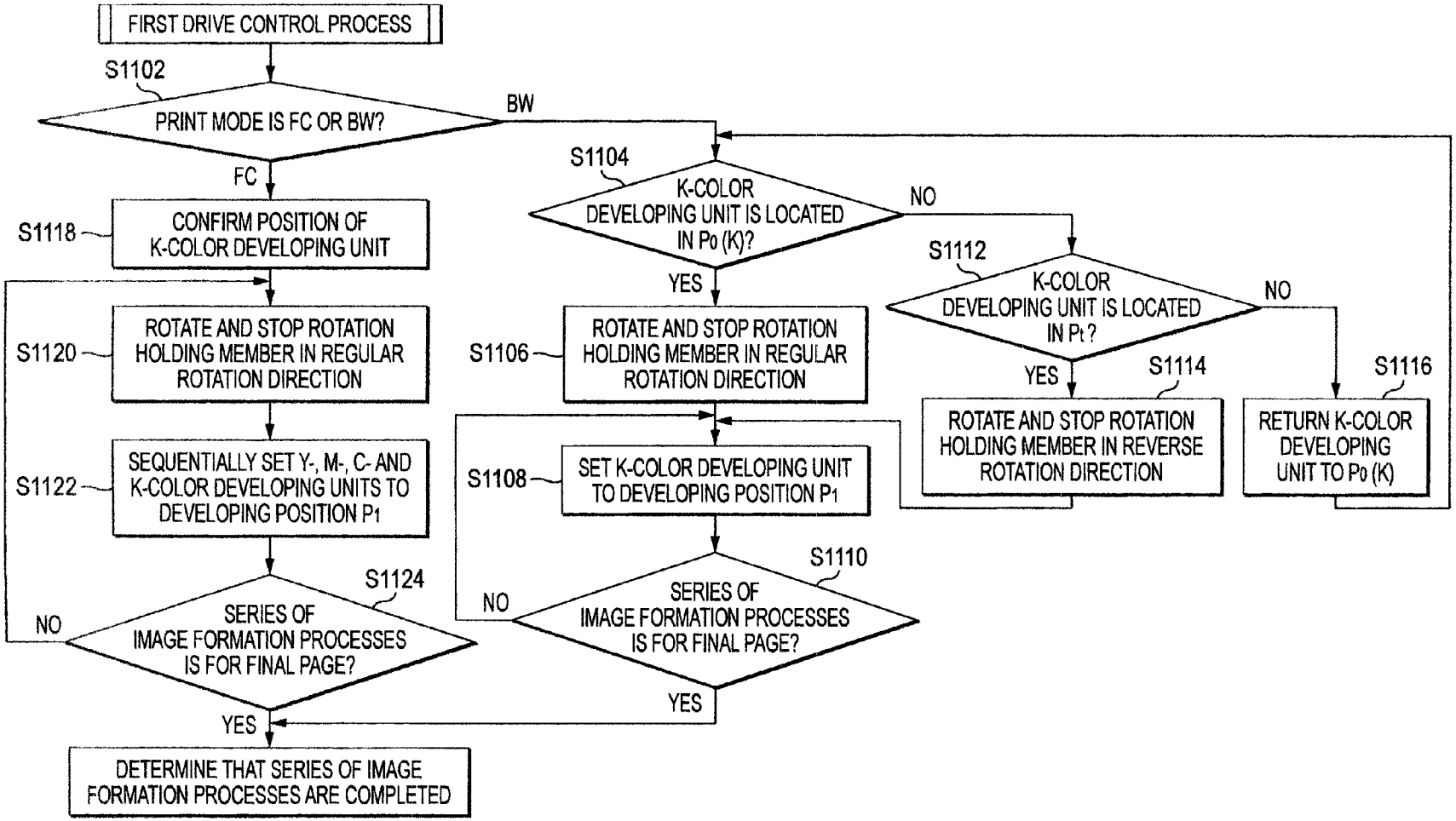
FIG. 11 is a flowchart showing a first drive control process during image formation in FIG. 10.

FIG. 11 is a flow chart showing details of the first drive control process at the step S1006 of FIG. 10. The control device 100 first determines at step S1102 as to whether a print mode is FC (full color mode) or BW (single color black mode).

If the control device 100 determines that the print mode is the BW mode (BW at step S1102), the control device 100 proceeds to step S1104 and determines as to whether or not the K-color developing unit 50*a* is located in the initial waiting position $P_0$(K) (for example, see FIG. 5). If the control device 100 determines that the K-color developing unit 50*a* is located in the initial waiting position $P_0$(K), the control device 100 proceeds to step S1106 and rotates and stops the rotation holding member 41 in the regular rotation direction $m_1$ (the rotation direction indicated by the arrow in FIG. 5), and then sets the K-color developing unit 50*a* to the developing position $P_1$ for execution of the developing operation (step S1108). Then, the control device 100 determines at step S1110 as to whether or not the series of image formation processes reach a final page. If the control device 100 determines that the series of image formation processes have not yet reached the final page (No at the step S1110), the control device 100 causes the K-color developing device 50*a* to repeat the developing operation at step S1108. Otherwise (Yes at the step S1110), the control device 100 terminates the first drive control process, and proceeds to the step S1008 (see FIG. 10). In other words, the control device 100 causes the K-color developing device 50*a* to repeatedly perform the developing operation until the series of image formation processes reach the final page.

If the control device 100 determines that the K-color developing unit 50*a* is not located in the initial waiting position $P_0$(K) (No at step S1104), the control device 100 proceeds to step S1112 and determines as to whether or not the K-color developing unit 50*a* is located in the temporary retraction position $P_t$. If the control device 100 determines that the K-color developing unit 50*a* is located in the temporary retraction position $P_t$ (Yes at the step S1112), the control device 100 proceeds to step S1114 and rotates and stops the rotation holding member 41 in the reverse rotation direction $m_2$ (opposite direction to the direction indicated by the arrow in FIG. 5), and then sets the K-color developing unit 50*a* to the developing position $P_1$ for execution of the developing operation (step S1108). Then, the control device 100 performs the process at the step S1110 as described above. In other words, the control device 100 causes the K-color developing device 50*a* to repeatedly perform the developing operation until the series of image formation processes reach the final page.

If the control device 100 determines that the K-color developing unit 50*a* is not located in the temporary retraction position $P_t$ (No at the step S1112), that is, the K-color developing unit 50*a* is located in a position other than the initial waiting position $P_0$(K) and the temporary retraction position $P_t$, the control device 100 returns the K-color developing unit 50*a* to the initial waiting position $P_0$(K) (step S1116), and then proceeds to the step S1104. At this time, since the K-color developing unit 50*a* is returned to the initial waiting position $P_0$(K) at the step S1116, the control device 100 makes a positive determination (Yes) at the step S1104. Then, the control device 100 performs the processes at steps S1108 and S1110 as described above. That is, the control device 100 causes the K-color developing device 50*a* to repeatedly perform the developing operation until the series of image formation processes reach the final page.

If the control device 100 determines that the print mode is the FC mode (FC at the step S1102), the control device 100 proceeds to step S1118 and checks a position of the K-color developing unit 50*a*. Then, the control device 100 rotates and stops the rotation holding member 41 in the regular rotation direction $m_1$ (step S1120), and sequentially sets the Y-color developing unit 50*b*, the M-color developing unit 50*c*, the C-color developing unit 50*d* and the K-color developing unit 50*a* to the developing position $P_1$ for execution of the developing operation by the respective developing units 50 (step S1122). Then, the control device 100 determines at step S1124 as to whether or not the series of image formation processes reach a final page. If the control device 100 determines that the series of image formation processes have not yet reached the final page (No at the step S1124), the control device 100 repeats the processes at the steps S1120 and S1122. Otherwise (Yes at the step S1124), the control device 100 terminates the first drive control process, and proceeds to the step S1008 (see FIG. 10). In other words, the control device 100 causes each developing device 50 to repeatedly perform the developing operation until the series of image formation processes reach the final page.

In the FC mode, even if the K-color developing device 50 is not located in the initial waiting position $P_0$(K), the control device 100 rotates the rotation holding member 41 in the regular rotation direction $m_1$ (step S1120) and first sets the Y-color developing unit 50*b* to the developing position $P_1$ (step S1122). Therefore, it is possible to rapidly set the Y-color developing unit 50*b* to the developing position $P_1$ of the rotary-type developing device 40 in response to the image formation instruction of the FC mode.

—Second Drive Control Process—

Figure 12:
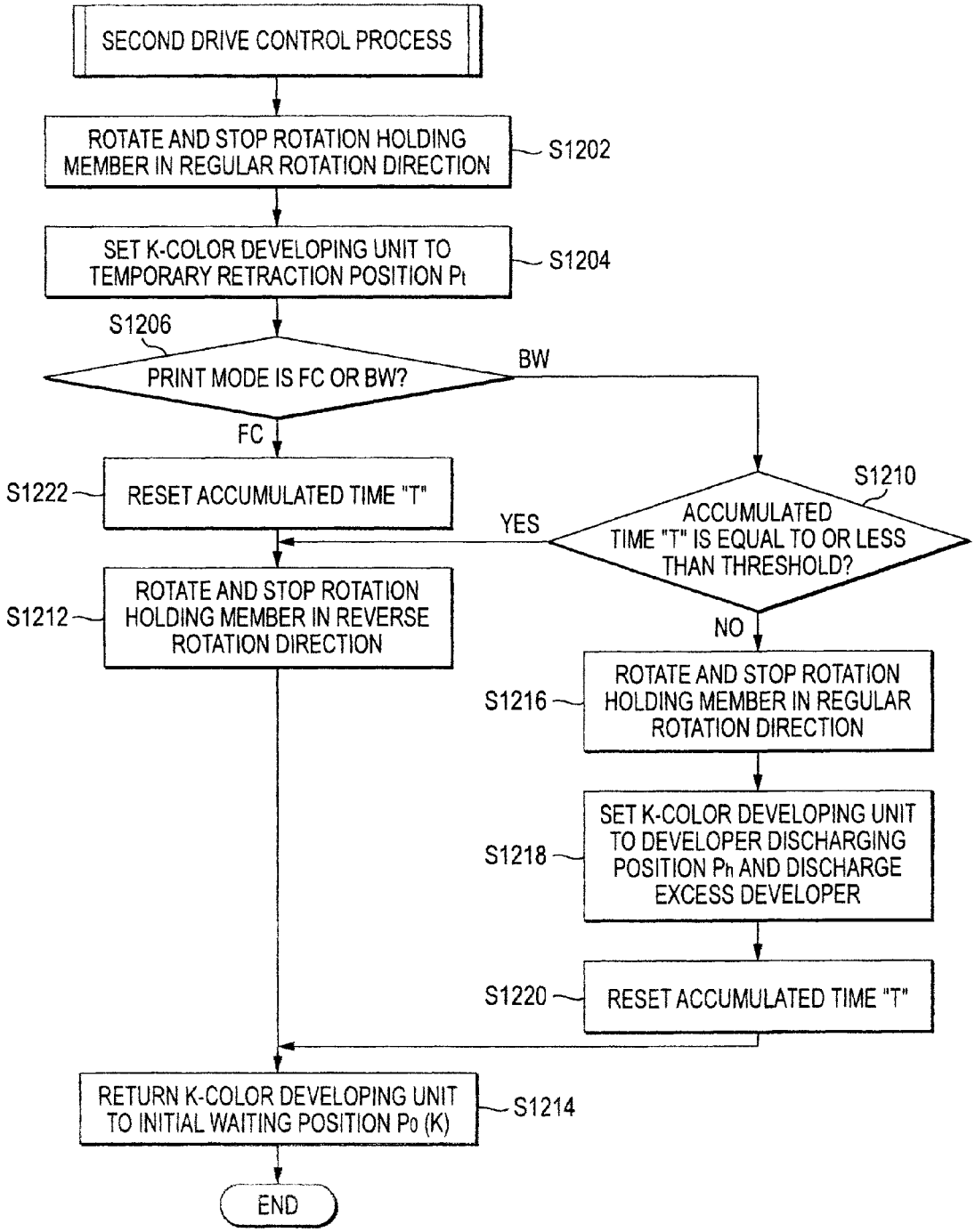
FIG. 12 is a flowchart showing a second drive control process at an end of the image formation in FIG. 10.

FIG. 12 is a flow chart showing details of the second drive control process at the step S1010 of FIG. 10. If the control device 100 determines that the series of image formation processes are completed (Yes at the step S1008 of FIG. 10), the control device 100 rotates and stops the rotation holding member 41 in the regular rotation direction $m_1$ (step S1202), and temporarily retreats the K-color developing unit 50*a* to the temporary retraction position $P_t$ (step S1204).

In this state, the control device 100 determines at step S1206 as to whether the print mode is the FC mode or the BW mode. If the control device 100 determines that the print mode is the BW mode (BW at the step S1206), the control device 100 proceeds to step S1210. As described above, the control device 100 accumulates a value indicated by the information corresponding to the amount of the developer supplied from the developer supplying mechanism 70 of each developing unit 50 every time the developer supplying mechanism 70 of each developing unit 50 supplies the developer, and stores the accumulates value in the storing portion of the control device 100. For example, the storage portion of the control device 100 stores accumulated time which is required for the motor 106 to supply the developer from the developer supplying mechanism 70 of the K-color developing unit 50*a* to the developer circulation path 58 of the K-color developing unit 50*a*. At the step S1210, the control device 100 determines as to whether or not the accumulated time "T" is equal to or less than a threshold (an example of a second specific value).

If the control device 100 determines that the accumulated time "T" is equal to or less than the threshold (Yes at the step S1210), the control device 100 rotates and stops the rotation holding member 41 in the reverse rotation direction $m_2$ (step S1212) and returns the K-color developing unit 50*a* to the initial waiting position $P_0$(K) (step S1214).

If the control device 100 determines that the accumulated time "T" exceeds the threshold (No at the step S1210), the control device 100 rotates and stops the rotation holding member 41 in the regular rotation direction $m_1$ (step S1216), sets the K-color developing unit 50*a* to the developer discharging position $P_h$ to discharge the excess developer (step S1218), and resets the accumulated value (e.g., the accumulated time "T") stored in the storage portion of the control device 100 (step S1220). Then, the control device 100 returns the K-color developing unit 50*a* to the initial waiting position $P_0$(K) (step S1214).

If the control device 100 determines that the print mode is the FC mode (FC at step S1206), the control device 100 proceeds to step S1222. The rotary-type developing device 40 according to this exemplary embodiment is configured so that when the Y-color developing unit 50*b* is located in the developing position $P_1$, the K-color developing unit 50*a* is located in the developer discharging position $P_h$ (see step S153 of FIG. 15). When the Y-color developing unit 50*b* is executing the development operation in the full color (FC) mode, the control device 100 causes the K-color developing unit 50*a*, which is located in the developer discharging position $P_h$, to discharge the excess developer. Therefore, at the step S1222, the control device 100 resets the accumulated value (e.g., the accumulated time "T") stored in the storage portion of the control device 100. It is noted that, when any of the developing units 50*c*, 50*d* and 50*a* is executing the development operation in the full color (FC) mode, the control device 100 may cause the developing unit 50 (50*b*, 50*c* and 50*d*) which is located in the developer discharging position $P_h$ to discharge the exceed developer. Then, the control device 100 rotates and stops the rotation holding member 41 in the reverse rotation direction $m_2$ (step S1212) and returns the K-color developing unit 50*a* to the initial waiting position $P_0$(K) (the step S1214).

—Handling of Next Image Formation Instruction During Second Drive Control Process—

Figure 13:
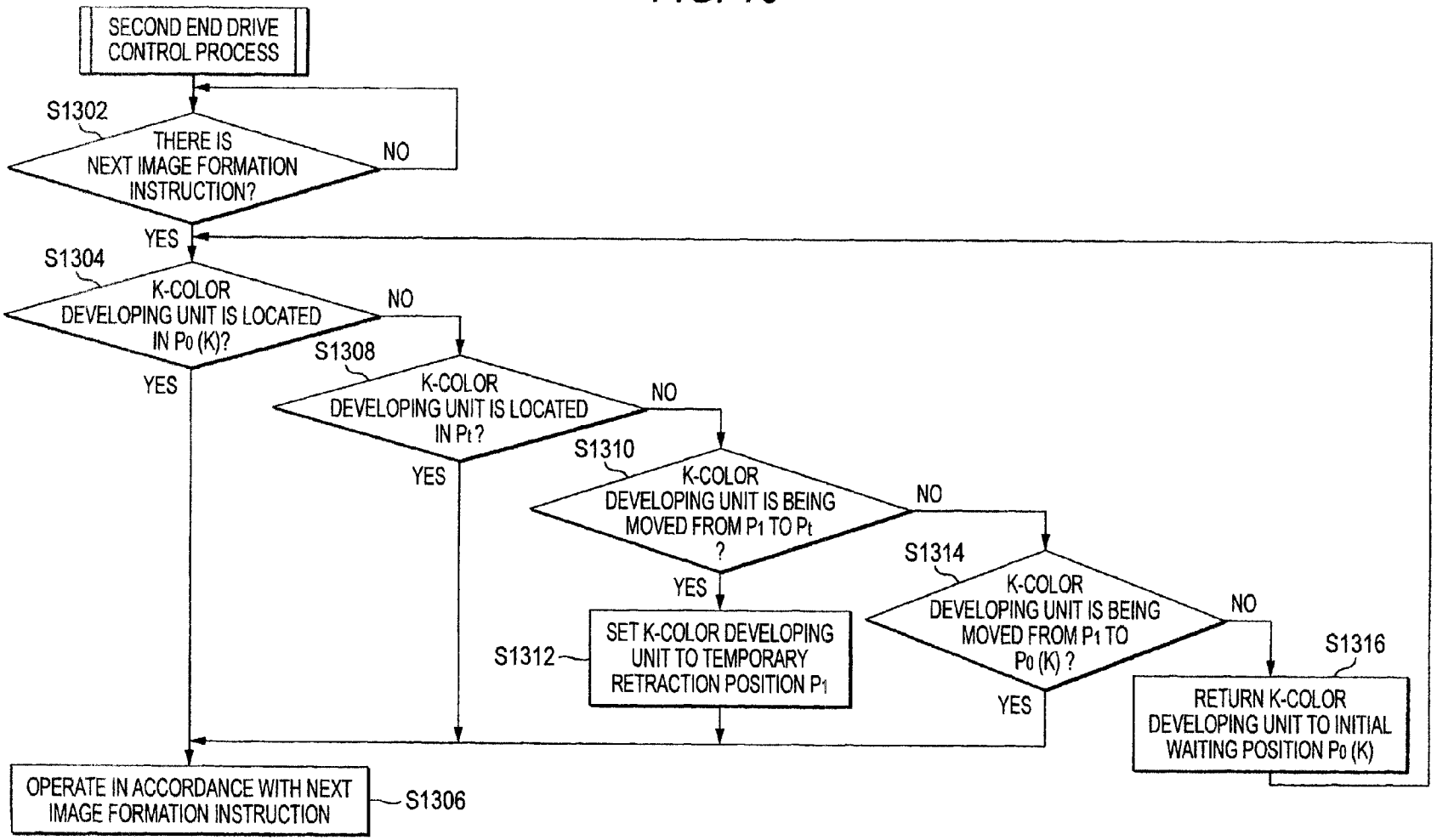
FIG. 13 is a flowchart relating to a relationship with a next image formation instruction that is received during the second drive control process shown in FIGS. 10 and 12.

A next image formation instruction is sometimes given during the second drive control process performed at the step 1010 of FIG. 10 (details of which are shown in FIG. 12). FIG. 13 is a flow chart showing how to deal with a next image formation instruction that is given during the second drive control process.

The control device 100 determines at step S1302 as to whether or not receiving a next image formation instruction. It is noted that the process at the step S1302 is performed in parallel with the processes shown in FIG. 12 (the second drive control process). If the control device 100 determines that no next image formation instruction is received (No at the step S1302), then the control device 100 repeats the process at the step S1302; otherwise (Yes at the step S1302), the control device 100 proceeds to step S1304. The control device 100 determines at the step S1304 as to whether or not the K-color developing device 50*a* is located in the initial waiting position $P_0$(K). If the control device 100 determines that the K-color developing device 50*a* is located in the initial waiting position $P_0$(K) (Yes at the step S1304), the control device 100 operates in accordance with the next image formation instruction (step S1306). Otherwise (No at step S1304), the control device 100 determines at step S1308 as to whether or not the K-color developing device 50*a* is located in the temporary retraction position $P_t$. If the control device 100 determines that the K-color developing device 50*a* is located in the temporary retraction position $P_t$ (Yes at the step S1308), the control device 100 operates in accordance with the next image formation instruction (step S1306). Otherwise (No at the step S1308), the control device 100 proceeds to step S1310.

At the step S1310, the control device 100 determines as to whether or not the K-color developing unit 50*a* is being moved from the developing position $P_1$ to the temporary retraction position $P_t$. If the control device 100 determines that the K-color developing unit 50*a* is being moved from the developing position $P_1$ to the temporary retraction position $P_t$ (Yes at the S1310), the control device 100 sets the K-color developing unit 50*a* to the temporary retraction position $P_t$ (step S1312), and then operates in accordance with the next image formation instruction (step S1306). Otherwise (No at the step S1310), the control device 100 proceeds to step S1314.

At the step S1314, the control device 100 determines as to whether or not the K-color developing unit 50*a* is being moved from the temporary retraction position $P_t$ to the initial waiting position $P_0$(K). If the control device 100 determines that the K-color developing unit 50*a* is being moved from the temporary retraction position $P_t$ to the initial waiting position $P_0$(K) (Yes at the step S1314), the control device 100 operates in accordance with the next image formation instruction (step S1306). Otherwise (No at the step S1314), the control device 100 sets the K-color developing unit 50*a* to the initial waiting position $P_0$(K) (step S1316), and then returns to the step S1304. At this time, since the K-color developing unit 50*a* is located in the initial waiting position $P_0$(K), the control device 100 proceeds from the step S1304 to the step S1306.

—Schematic Explanation of Series of Image Formation Processes—

Figure 14:
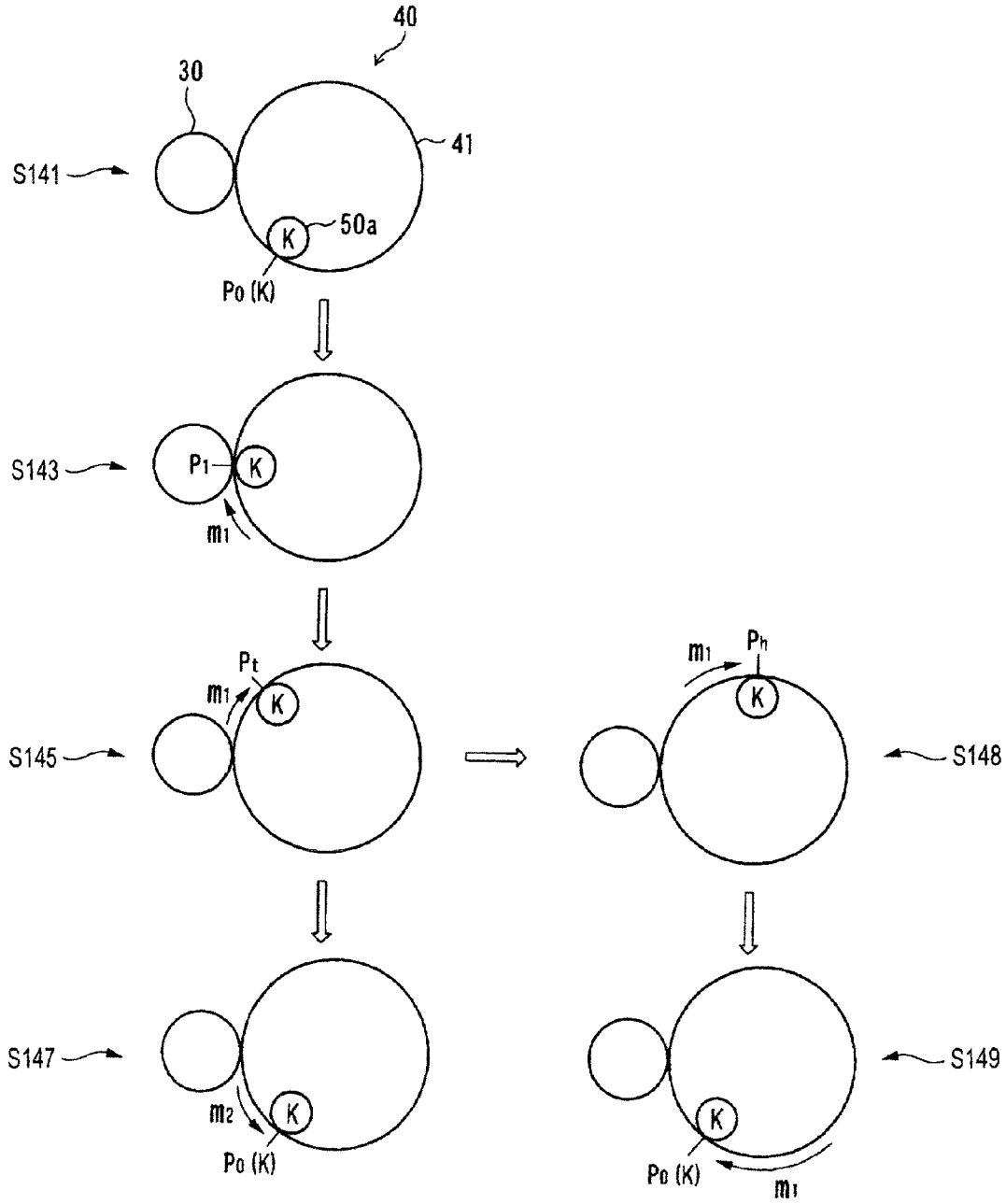
FIG. 14 is an explanatory view schematically showing the image formation process using the single color (K) according to the first exemplary embodiment.

FIG. 14 is a schematic view showing an image formation process using a single color (K).

In FIG. 14, at first, the K-color developing unit 50*a* is located in the initial waiting position $P_0$(K) (step S141). The state shown in the step S141 of FIG. 14 corresponds to Yes at the step S1104 of FIG. 11. The K-color developing unit 50*a* is rotated in the regular rotation direction $m_1$ and is set to the developing position P1 for execution of the development operation (step S143). The state shown in the step S143 corresponds to the steps S1106, S1108 and S1110 of FIG. 11. Then, after the series of image formation processes are completed (Yes at the step S1008 of FIG. 10), the K-color developing unit 50*a* is rotated in the regular rotation direction $m_1$, and is set to the temporary retraction position $P_t$ (step S145). The state shown in the step S145 corresponds to the steps S1202 and S1204 of FIG. 12. If the condition for discharge of the excess developer is not met (e.g., Yes at step the S1210 of FIG. 12), the K-color developing unit 50*a* is rotated the reverse rotation direction $m_2$ and is returned to the initial waiting position $P_0$(K) (step S147). The state shown in the step S147 corresponds to Yes at the step S1210 and the steps S1212 and S1214.

Figures 16A, 16B:
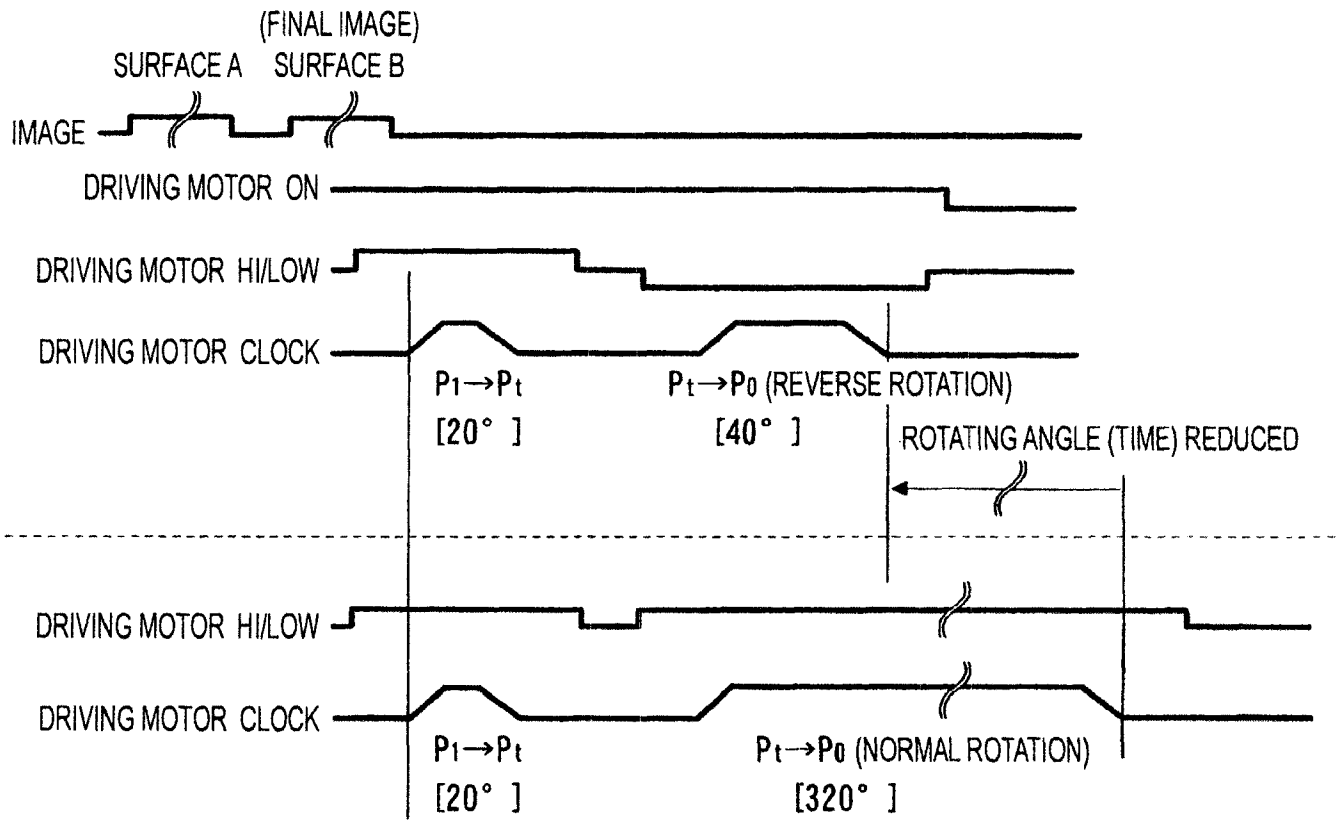
FIG. 16A is a timing chart showing the image formation process using the single color (K) according to the first exemplary embodiment.
FIG. 16B is a timing chart showing an image formation process using the single color (K) according to a comparative example.

FIG. 16A is a timing chart for the driving motor 102 according to this exemplary embodiment. FIG. 16B is a timing chart for a driving motor according to a comparative example.

In FIG. 16A, it can be understood that a time required to return the K-color developing unit 50*a* from the developing position $P_1$ to the initial waiting position $P_0$ is shorter than that in the comparative example shown in FIG. 16B (in which the K-color developing unit 50*a* is rotated only the regular rotation direction $m_1$ in returning to the initial waiting position). In FIG. 16A, it is assumed that an angle between (i) a segment connecting the initial waiting position $P_0$ and the rotation shaft of the rotation holding member 41 and (ii) a segment connecting the developing position $P_1$ and the rotation shaft of the rotation holding member 41 is 20 degrees, and that an angle between (1) a segment connecting the developing position $P_1$ and the rotation shaft of the rotation holding member 41 and (ii) a segment connecting the temporary retraction position $P_t$ and the rotation shaft of the rotation holding member 41 is 20 degrees.

Also, if the condition for discharge of the excess developer is met (e.g., No at step the S1210 of FIG. 12), the K-color developing unit 50*a* is further rotated in the regular rotation direction $m_1$ and stopped, and is set into the developer discharging position $P_h$. An operation for discharging the excess developer is carried out (step S148). The step S148 corresponds to No at the step S1210 and the steps S1216 to S1220. Then, the K-color developing unit 50*a* is rotated in the regular rotation direction $m_1$ to be returned to the initial waiting position $P_0$(K) (step S149). The state shown in the step S149 corresponds to the step S1214 of FIG. 12.

Figure 15:
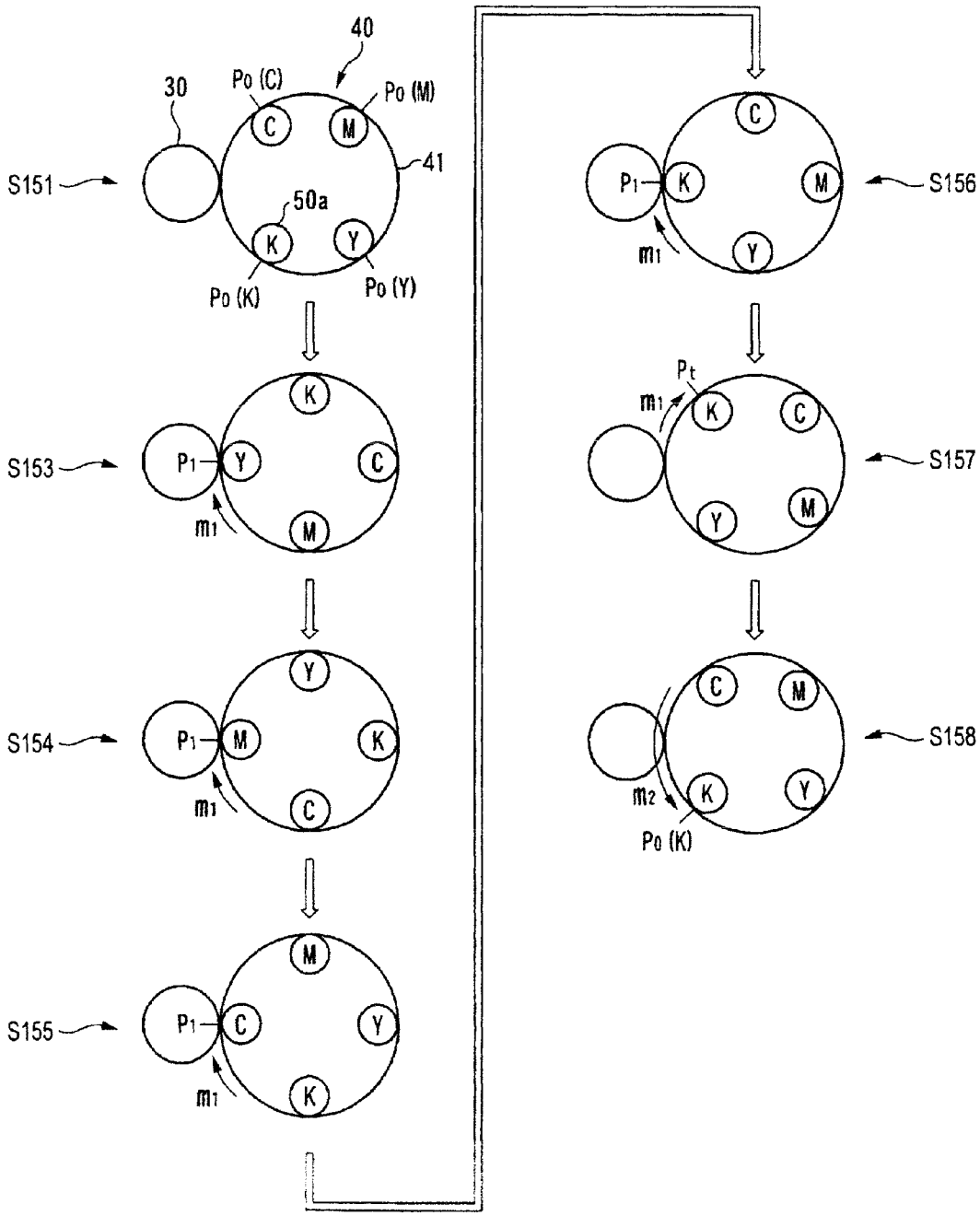
FIG. 15 is an explanatory view schematically showing the image formation process using the plural colors (YMCK) according to the first exemplary embodiment.

FIG. 15 is a schematic view showing an image formation process using plural colors (YMCK).

In FIG. 15, at first, the K-color developing unit 50*a* is located in the initial waiting position $P_0$(K) (step S151). Then, the rotation holding member 41 is rotated in the regular rotation direction $m_1$, and the Y-color developing unit 50*b* is set into the developing position $P_1$ for development of a yellow component (Y) (step S153). Furthermore, the rotation holding member 41 is rotated in the regular rotation direction $m_1$ and stopped so that the M-color developing unit 50*c*, the C-color developing unit 50*d* and the K-color developing unit 50*a* are sequentially set to the developing position $P_1$ for development of the respective color components (M, C, K) (steps S154 to S156). The states shown in the steps S153 to S156 correspond to the steps S1120 to S1124 of FIG. 11.

When the series of image formation processes are completed, then the K-color developing unit 50*a* which is finally located in the developing position $P_1$ is rotated in the regular rotation direction $m_1$ and is set to the temporary retraction position $P_t$ (step S157). The state shown in the step S157 corresponds to the steps S1202 and S1204 of FIG. 12. Then, the K-color developing unit 50*a* is rotated in the reverse rotation direction $m_2$ and is returned to the initial waiting position $P_0$(K) (step S158). The state shown in the step S158 corresponds to the steps S1212 and S1214 of FIG. 12.

What is claimed is:

1. An image forming apparatus comprising:

an image carrier that carries an electrostatic latent image;

a rotary-type developing device including a rotation holding member that is forwardly and reversely rotatable, and a plurality of developing units that are mounted on the rotation holding member so that the electro static latent image carried by the image carrier is visualized with a single color or plural colors, wherein the rotation holding member is configured to stop rotating so that any of the developing units stops in a developing position where said any of the developing units faces the image carrier, and in a state where said any of the developing units stops in the developing position, said any of the developing unit stopping in the developing position performs a development operation; and a development control device that controls the rotary-type developing device, wherein each developing unit of the rotary-type developing device includes a developing container having a development opening that faces the image carrier when each developing unit stops in the developing position, and a developer circulation path that accommodates a two-component developer containing a toner and a carrier and circulates the developer, a developer carrying member that faces the development opening of the developing container and carries the developer while rotating, and a plurality of stirring-and-conveying members that are rotatable and extend in a direction of a rotating axis of the developer carrying member in the developer circulation path of the developing container, the stirring-and-conveying members that rotate to stir and convey the developer along the developer circulation path, the development control device includes a receiving unit that receives an image formation instruction relating to a series of image formation processes using the single color or the plural colors, a first determination unit that determines as to whether or not the series of image formation processes using the single color or the plural colors in the rotary-type developing device are completed, a first drive control unit that, from time when the receiving unit receives the image formation instruction to time when the first determination unit determines that the series of image formation processes are completed, rotates the rotation holding member of the rotary-type developing device in a regular rotation direction, and stops one or ones of the developing units in the development position sequentially so that the one or ones of the developing units performs the development operation, and a second drive control unit that, when the first determination unit determines that the series of image formation processes are completed, rotates the rotation holding member of the rotary-type developing device in a reverse rotation direction opposite to the regular rotation direction to return the developing unit, which is finally located in the developing position in the image formation processes using the single color or the plural colors, to an initial waiting position, and when any of the developing units is located in the initial waiting position, none of the developing units is located in the developing position.

2. The image forming apparatus according to claim 1, wherein when the receiving unit receives a next image formation instruction before the developing unit, which is finally located in the developing position, is returned to the initial waiting position, the first drive control unit is selected with being given a priority over the second drive control unit.

3. The image forming apparatus according to claim 1, wherein the initial waiting position is located upstream of the developing position in the regular rotation direction of the rotation holding member, a temporary retraction position is located in downstream of the developing position in the regular rotation direction of the rotation holding member, and the second drive control unit rotates the rotation holding member in the regular rotation direction to move the developing unit, which is finally located in the developing position in the image formation processes using the single color or the plural color, to the temporary retraction position, and unless the receiving unit receives a next image formation instruction before a retraction time has elapsed since the developing unit, which is finally located in the developing position in the image formation processes, is moved to the temporary retraction position, the second drive control unit moves the rotation holding member in the reverse rotation direction so as to return the developing unit, which is located in the temporary retraction position, to the initial waiting position.

4. The image forming apparatus according to claim 3, wherein when the receiving unit receives the next image formation instruction before the retraction time has elapsed since the developing unit, which is finally located in the developing position in the image formation processes, is moved to the temporary retraction position, if the next image formation instruction indicates image formation processes using a single color corresponding to the developing unit, which is located in the temporary retraction position, the first drive control unit rotates the rotation holding member in the reverse rotation direction to move the developing unit, which is located in the temporary retraction position, to the developing position to perform the development operation, and otherwise, the first drive control unit rotates the rotation holding member in the regular rotation direction to move one or ones of the developing units, which are used in image formation processes indicated by the next image formation instruction, sequentially to the development position so that the one or ones of the developing units performs the development operation.

5. The image forming apparatus according to claim 1, wherein before the receiving unit receives the image formation instruction, the developing unit for forming a single color image with a specific color which is most frequently used among the plural colors is located in the initial waiting position and is closest, along the regular rotation direction, to the developing position than the other developing units, and in image formation processes using all the plural colors, the first drive control unit uses the other developing units prior to using the developing unit of the specific color, and finally uses the developing unit of the specific color.

6. The image forming apparatus according to claim 1, wherein each developing unit further includes a developer supplying port that is provided in a part of the developing container, a new developer being able to be supplied through the developer supplying port.

7. The image forming apparatus according to claim 1, wherein each developing unit further includes a developer supplying port that is provided in a part of the developing container, a new developing, containing a toner and a carrier, being able to be supplied through the developer supplying port, and a developer discharging port that is provided in a part of the developing container, an excess developer being able to be discharged through the developer discharging port.

8. The image forming apparatus according to claim 7, wherein when each developing unit is located in a developer discharging position which is downstream of the developing position in the regular rotation direction of the rotation holding member, each developing unit can discharge the excess developer through the developer discharging portion, the development control device further includes a second determination unit and a third drive control unit, the second determination unit determines as to whether or not an amount of the excess developer to be discharged from the developing unit of a specific color exceeds a first specific amount, and if the second determination unit determines that the amount of the excess developer to be discharged from the developing unit of the specific color exceeds the first specific amount, the third drive control unit rotates the rotation holding member in the regular rotation direction to move the developing unit of the specific color to the developer discharging position, to discharge the excess developer through the developer discharging port of the developing unit of the specific color and then to return the developing unit of the specific color to the initial waiting position.

9. The image forming apparatus according to claim 8, wherein the second determination unit accumulates a value indicated by information corresponding to an amount of the new developer supplied through the developer supplying port and determines as to whether or not the amount of the excess developer to be discharged from the developing unit of the specific color exceeds the first specific amount, based on whether or not the accumulated value exceeds a second specific value.

10. The image forming apparatus according to claim 9, wherein the third drive control unit initializes the value accumulated by the second determination unit when the accumulated value exceeds the second specific value or when image formation processes are performed based on an image formation instruction for enabling the developing unit of the specific color to pass through the developer discharging position, before the accumulated value exceeds the second specific value.

11. The image forming apparatus according to claim 8, wherein if the second determination unit determines that the amount of the excess developer to be discharged from the developing unit of the specific color exceeds the first specific amount, the third drive control unit stops rotation of the rotation holding member to stop the developing unit of the specific color in the developer discharging position, causes the excess developer to be discharged through the developer discharging port of the developing unit of the specific color and then, rotates the rotation holding member again.

12. The image forming apparatus according to claim 8, wherein at a time when the first determination unit determines that the series of image formation processes are completed, a priority is given to a control process performed by the third drive control unit over a control process performed by the second drive control unit, and if the second determination unit determines that the excess developer is equal to or less than the first specific amount at the time when the first determination unit determines that the series of image formation processes are completed, the second drive control unit rotates the rotation holding member of the rotary-type developing device in the reverse rotation direction to return the developing unit, which is finally located in the developing position in the image formation processes, to the initial waiting position.

13. An image forming apparatus comprising:

an image carrier that carries an electrostatic latent image;

a rotary-type developing device including a rotation holding member that is forwardly and reversely rotatable, and a plurality of developing units that are mounted on the rotation holding member so that the electro static latent image carried by the image carrier is visualized with a single color or plural colors, wherein the rotation holding member is configured to stop rotating so that any of the developing units stops in a developing position where said any of the developing units faces the image carrier, and in a state where said any of the developing units stops in the developing position, said any of the developing unit stopping in the developing position performs a development operation; and a development control device that controls the rotary-type developing device, wherein each developing unit of the rotary-type developing device includes a developing container having a development opening that faces the image carrier when each developing unit stops in the developing position, and a developer circulation path that accommodates a two-component developer containing a toner and a carrier and circulates the developer, a developer carrying member that faces the development opening of the developing container and carries the developer while rotating, and a plurality of stirring-and-conveying members that are rotatable and extend in a direction of a rotating axis of the developer carrying member in the developer circulation path of the developing container, the stirring-and-conveying members that rotate to stir and convey the developer along the developer circulation path, the development control device includes a receiving unit that receives an image formation instruction relating to a series of image formation processes using the single color or the plural colors, a first determination unit that determines as to whether or not the series of image formation processes using the single color or the plural colors in the rotary-type developing device are completed, a first drive control unit that, from time when the receiving unit receives the image formation instruction to time when the first determination unit determines that the series of image formation processes are completed, rotates the rotation holding member of the rotary-type developing device in a regular rotation direction, and stops one or ones of the developing units in the development position sequentially so that the one or ones of the developing units performs the development operation, and a second drive control unit that, when the first determination unit determines that the series of image formation processes are completed, rotates the rotation holding member of the rotary-type developing device in a reverse rotation direction opposite to the regular rotation direction to return the developing unit, which is finally located in the developing position in the image formation processes using the single color or the plural colors, to an initial waiting position, and when any of the developing units is located in the initial waiting position, none of the developing units is located in the developing position, wherein each developing unit further includes a developer discharging port that is provided in a part of the developing container, and when each developing unit is located in a developer discharging position which is downstream of the developing position in the regular rotation direction of the rotation holding member, each developing unit can discharge an excess developer through the developer discharging port.

14. The image forming apparatus according to claim 13, wherein each developing unit further includes a developer supplying port that is provided in a part of the developing container, a new developing, containing a toner and a carrier, being able to be supplied through the developer supplying port.

15. The image forming apparatus according to claim 14, wherein the development control device further includes a second determination unit and a third drive control unit, the second determination unit determines as to whether or not an amount of the excess developer to be discharged from the developing unit of a specific color exceeds a first specific amount, and if the second determination unit determines that the amount of the excess developer to be discharged from the developing unit of the specific color exceeds the first specific amount, the third drive control unit rotates the rotation holding member in the regular rotation direction to move the developing unit of the specific color to the developer discharging position, to discharge the excess developer through the developer discharging port of the developing unit of the specific color and then to return the developing unit of the specific color to the initial waiting position.

* * * * *